United States Patent [19]

Franklin et al.

[11] Patent Number: 4,558,648

[45] Date of Patent: Dec. 17, 1985

[54] ENERGY-RECYCLING SCISSORS LIFT

[75] Inventors: Duane R. Franklin, Northridge; Archibald D. Evans, Newbury Park, both of Calif.

[73] Assignee: Lift-R Technologies, Inc., Los Angeles, Calif.

[21] Appl. No.: 534,175

[22] Filed: Sep. 20, 1983

[51] Int. Cl.[4] ..... A47B 9/16

[52] U.S. Cl. ..... 108/147; 108/136; 108/144; 108/145; 248/421; 248/588

[58] Field of Search ..... 108/147, 145, 144, 136; 248/421, 588, 585, 584, 280.1, 281.1

[56] References Cited

U.S. PATENT DOCUMENTS

| | | | |
|---|---|---|---|
| 727,192 | 5/1903 | Payne . | |
| 744,613 | 11/1903 | Reimold | 108/144 |
| 758,431 | 4/1904 | Edeline . | |
| 1,078,759 | 11/1913 | Wichertjes . | |
| 1,817,418 | 8/1931 | Munns . | |
| 2,267,973 | 12/1941 | Demcak | 108/136 X |
| 2,471,901 | 5/1949 | Ross . | |
| 2,645,538 | 7/1953 | Segal | 248/421 |
| 2,829,863 | 4/1958 | Gibson | 108/147 X |
| 3,007,676 | 11/1961 | Javorik . | |
| 3,110,476 | 11/1963 | Farris | 108/147 X |
| 3,245,366 | 4/1966 | Fox | 108/145 |
| 3,282,566 | 11/1966 | Clarke | 108/144 X |
| 3,410,328 | 11/1968 | Sasai | 108/145 |
| 3,472,183 | 10/1969 | Goodman | 108/147 |
| 3,750,846 | 8/1973 | Huxley, III . | |
| 3,805,712 | 4/1974 | Taylor et al. | 108/145 |
| 4,097,941 | 7/1978 | Merkel | 108/144 X |
| 4,151,804 | 5/1979 | Wache et al. | 108/147 |
| 4,381,714 | 5/1983 | Henneberg et al. | 108/147 |
| 4,391,345 | 7/1983 | Paul . | |

FOREIGN PATENT DOCUMENTS

| | | | |
|---|---|---|---|
| 17914 | 10/1980 | European Pat. Off. | 248/421 |
| 1920696 | 6/1978 | Fed. Rep. of Germany | 248/588 |
| 2915259 | 10/1980 | Fed. Rep. of Germany | 248/421 |
| 3037375 | 5/1982 | Fed. Rep. of Germany | 108/145 |
| 967399 | 8/1964 | United Kingdom | 108/147 |
| 981991 | 2/1965 | United Kingdom | 108/147 |

*Primary Examiner*—William E. Lyddane
*Assistant Examiner*—Thomas A. Rendos
*Attorney, Agent, or Firm*—Romney Golant Martin & Ashen

[57] ABSTRACT

A scissors mechanism supports a platform, and is coupled to a sealed gas cylinder or other energy-storage device in such a way that the cylinder tends to lift the platform, and an article on the platform—such as a television set, a bar, office equipment, a tabletop, etc. The lift may be enclosed in a compact cabinet so that the article on the platform is concealed when down, and accessible when up.

Energy released in lowering the article is stored in compression of gas within the storage device, and subsequently reused in raising the article. Compensation is provided for the strongly varying mechanical advantage provided by the scissors mechanism, so that the stored energy can operate smoothly on the article throughout the entire operating range of the scissors, making possible the use of the energy-recycling system.

In one embodiment the stored energy alone is made capable of raising the article through the entire range of the mechanism, but the article can be easily lowered by manual application of light downward force—even though, for mechanical simplicity, the energy-storage device remains connected to raise the article.

In another embodiment this manual application of controlling force is replaced by a remote-control actuator, such as a small motor or a small hydraulic or pneumatic cylinder. Such a remote-control actuator applies pilot forces upward or downward to control the direction of operation, while the sealed gas cylinder generally bears the weight of the platform and the article on it.

10 Claims, 12 Drawing Figures

ENERGY-RECYCLING SCISSORS LIFT

BACKGROUND

1. Field of the Invention

This invention relates generally to scissors lifts, and more particularly to such lifts adapted for use in repetitively raising and lowering items of furniture, home entertainment divices, office equipment, and other such articles. Some preferred embodiments of the invention repetitively raise and lower such articles in such a way as to provide access to the article when it is in a raised position and concealment when it is in a lowered position.

Although the invention is by no means limited to domestic or office usages, for convenience in this document it is sometimes referred to as a cabinetry lift.

2. Prior Art (a) Scissors Lifts: General History—Many ingenious people have developed ways to use scissors mechanisms to raise or extend platforms, baskets, and scaffolds carrying various sorts of payweights. In particular, several patents have addressed the problems encountered in initiating the extension of a scissors mechanism from a fully retracted or folded position. These patents will be identified below, and the reason for the initial-extension problem will be discussed.

As will be seen, however, none of these patents has dealt with the detailed behavior of a scissors mechanism at the opposite end of its operating range—that is to say, in its extended position—or even in the midregion between the extended and retracted positions. In the prior art, an extended scissors mechanism is retracted simply by removing, reducing or even reversing the primary driving force: the mechanism readily starts down. Moreover, the apparatuses used for application of external driving force to a scissors mechanism generally accommodate a relatively wide variation of resistance from the scissors mechanism; they simply pump in more energy. Thus, once the problems that occur near the retracted position have been solved, there has been no need to be concerned with the magnitude of the lifting force at the other end of the operating range.

(b) Tension-extended Scissors Systems—Perhaps the "first generation" of scissors lifts is typified by U.S. Pat. Nos. 1,078,759 and 1,817,418. The first of these issued in 1913 to Arend Wichertjes, and the second in 1931 to Arthur Munns. Both disclose multiple-stage scissors lifts—or, as they are sometimes called, "lazy tong" mechanisms. These are scissors lifts in which one "scissors" linkage drives another above it, which in turn may drive yet others.

Wichertjes and Munns respectively describe chain-controlled and cable-controlled scissors lifts. In each case the chains or cables are wrapped around the lateral pivots (and across the central pivots) of the successive scissors linkages. When tensioned, the chains or cables pull the lateral pivots together to extend the lift.

Wichertjes notes that "it might result in undue stress and strain upon the lazy-tongs to rely upon the chains . . . alone for extending the device and elevating the platform," and accordingly he provides an "auxiliary elevating device". The "stress and strain" to which Wichertjes alludes apparently arise from the fact that when a force that is purely lateral, or almost purely lateral, is applied to open or extend a fully folded or retracted scissors mechanism, there is a strong tendency for the mechanism to bind rather than to extend. When this happens, if the forces applied are increased the result is often to break something rather than to extend the mechanism.

The binding can be understood by studying the mechanism. The forces on the rigid members are directed almost exactly within and parallel to the lengths of those members, with at most a very small component of force directed perpendicular to the rigid members to rotate them about their pivot points. Often the "rigid" members of a loaded scissors mechanism that is fully folded are slightly deformed (bent or twisted) by the load, causing the rotational-tending force to be actually zero. Sometimes these forces are even caused to be applied in a direction that tends to rotate the arms to a more tightly folded position. Only when the scissors is partly open does there develop a sizable component of force directed to rotation in the proper direction and thereby to further extension.

Though Wichertjes does not say so, the tendency to bind is actually a special case—or an extreme manifestation—of the strongly varying mechanical advantage which a scissors mechanism presents to its driving force. When the driving force is applied to pull the ends of the legs at one end of the scissors straight toward each other, the mechanical advantage between the driving force and the weight to be moved at the far end of the scissors varies as the tangent of the angle between the legs and (for a vertical scissors) the horizontal. When the scissors mechanism is fully folded this angle is very nearly zero, the tangent and thus the mechanical advantage are likewise, and only a tiny fraction of any input force is therefore available to open the scissors (the rest, as already observed, being applied to break something).

Wichertjes resolves this impasse by providing a completely separate chain-drive mechanism for raising part of the scissors linkage vertically, in preparation for operating his main mechanism to extend the scissors by pulling its opposite pivot points together as previously described. Wichertjes' entire device generally is disadvantageous by virtue of being almost startlingly complicated or elaborate, and seemingly impractical by virtue of this intricacy.

Munns also directs his attention to the initial-extension problem, but he ascribes it (somewhat inaccurately, it would appear) to inadequate available "power'-'—rather than to the tendency to bind. He observes, "The mechanisms heretofore proposed for moving the lazy-tongs to extended position from a folded position have been such as to render very difficult the initial actuation thereof to the extent of requiring a relatively greater source of power and one wholly beyond the range of practicability particularly where the elevator is a portable one and great loads are adapted to be lifted." He adds that "although the pulley and cable mechanism thus far described is sufficient to move the lazy-tong structure when dealing with light loads, it is incapable of initiating movement of the lazy-tong structure when elevating relatively heavy loads."

Although Munns' text at some points appears inaccurate as to the problem which he is trying to solve, his text at other points is quite accurate as to the means applied to solve it: "the pulling force which may be said to be acting horizontally is . . . converted into a vertical force which operates to move the arms upward." By referring to "force" rather than "power", Munns here correctly focuses on the previously described adverse behavior of the mechanical advantage of a scissors mechanism at small angles. Whereas ample power may be available, the scissors mechanism misdirects the available force.

Munns' conversion redirects the line of action of the available force so that it can perform the desired work. Munns effects this conversion by separate members fixed to two of the scissors arms and extending a substantial distance downward from them, and pulley wheels at the lower ends of these arms; the cables crossing the bottom scissors stage are passed under these two pulley wheels, causing each cable to assume a "V" shape and thus creating a large vertical component of tension. This tension tends to raise the wheels, and operates the mechanism out of the range of positions in which binding is a serious problem—whereupon the primary mechanism takes over. Munns' device suffers from the severe disadvantage that his downward-extended extension members are very awkward or cumbersome, and in particular prevent collapsing the mechanism to a very shallow configuration.

Even after the Wichertjes or Munns mechanism has been elevated past the point at which binding is a serious problem, the adverse (that is, very low) mechanical advantage at small angles continues to require relatively large force levels for extension of the mechanism. Notwithstanding Munns' above-quoted comments, such force levels generally can be obtained through gearing. Nevertheless, the requirement of large forces can be a particularly severe problem if these forces must be borne by cables or chains in tension, since very strong (and therefore large-diameter and heavy) cables or chains are thereby required, and the apparatus as a whole must be very large, bulky, heavy, and expensive. The weight and expense of the necessary gearing further aggravates these factors.

Hence the auxiliary lifting arrangements of the Wichertjes and Munns devices are used to move the mechanisms not only out of the dead zone in which the scissors actually bind, but also past the range of positions in which the mechanical advantage is so unfavorable that (1) the driving force would be stalled, and/or (2) excessively heavy-duty force-transmitting elements would be required. It is emphasized that these devices of the prior art both operate by externally supplied energy, of which—in the past—the availability of an ample amount has generally been assumed. The auxiliary devices described merely serve to optimize the coupling of this externally supplied energy to drive the scissors.

Once the scissors legs in these mechanisms have moved a few degrees from the vertical, however, the auxiliary mechanisms are no longer needed. Even if stopped, the scissors can then be driven upward by the primary driving-energy source provided. In particular, neither Munns nor Wichertjes is concerned with reversing the direction of the mechanism from the fully extended position, since reversal is easily accomplished by removing, reducing or reversing the force applied to the driven end of the scissors.

A "second generation" of innovations in scissors mechanisms is offered by U.S. Pat. No. 4,391,345, which issued to Jim Paul on July 5, 1983. This patent discloses a much smaller, simpler, and more sophisticated approach to supplying the vertical component of force necessary to initiate extension of a cable-driven three-stage scissors mechanism.

Paul's device uses an eccentrically pivoted sheave a few inches in diameter, mounted to the scissors mechanism near the bottom. The sheave is readily rotated by the tension in the driving cable. It acts as a cam, raising the scissors legs through a few degrees of rotation and thereby past the region of very adverse mechanical advantage.

Paul suggests that the abandonment of cable-driven-scissors devices earlier in the century, in favor of hydraulic-cylinder-driven scissors devices, may have been due to the complex, cumbersome character of auxiliary apparatus used for the initial extension by inventors such as Wichertjes and Munns. Paul goes on to propose that his simpler and more compact initial-extension unit restores the cable-driven scissors to the realm of competitive practicality, since hydraulic systems are by comparison very heavy and expensive to operate.

However this may be in the field of large, vehicle-mounted, multiple-stage platform lifts, cable-driven systems are distinctly disadvantageous in the area of cabinetry lifts intended for high-volume manufacture and for final assembly in homes and offices by mechanically unskilled users or relatively unspecialized technicians. Cable-driven systems are characterized by a relatively large amount of manufacturing labor and inventory costs, because of the numerous small parts (particularly pulleys) that are involved. They also require a relatively large amount of final assembly work, and this work requires some level of specialized skill because of the necessity to thread the cables correctly and ensure that there are no snags. In addition cable-driven scissors lifts tend to be slow and rather noisy.

Nevertheless the principle of Paul's invention appears in modern devices, such as the line of electrically powered and cable-driven scissors lifts marketed by the firm Hafele America under the trade name "Open Sesame electric hideaway lift systems".

The Paul patent and the principles of the Hafele apparatus, like the earlier units previously discussed, are unconcerned with the details of operation of the scissors in the extended position. The purpose of the auxiliary devices in all these units is to facilitate operation near the retracted position of the scissors.

(c) Compression-extended Scissors Mechanisms—Preceding and paralleling Paul's innovation is the development of scissors mechanisms that are self-extending, driven by hydraulic cylinders or by electrical motors and screws. Generally at least one stage of the scissors mechanism in such devices is driven by pushing or pulling the legs together at one end, as in the cable-driven devices discussed previously; consequently the comments offered earlier regarding the tangent variation of mechanical advantage apply to these apparatuses as well.

U.S. Pat. No. 2,471,901 to William Ross, issued May 31, 1949, discloses one such system. Ross's apparatus provides a tiltable platform, one end being supported by a two-stage scissors. (It is a full or true scissors to the extent that it raises both stages vertically, though the upper or second stage is only a partial scissors in the sense that it does not hold the platform horizontal.) The other end is supported by an extension linkage that does not hold itself vertical as does a scissors. Only the former of these two mechanisms, accordingly, is pertinent to the present discussion.

Ross provides two features to mitigate the adverse mechanical advantage of the scissors mechanism in its retracted condition. First, he applies driving force from his hydraulic cylinder to a forcing point that is offset from the driven leg of the scissors; this geometry provides some rotation-tending component of force even when the mechanism is fully retracted. Second, Ross provides a second hydraulic cylinder which is mounted for purely vertical motion, to raise the first stage of the scissors bodily out of the low-mechanical-advantage region.

The primary and auxiliary hydraulic cylinders are both driven by a hand-cranked oil pump, to raise the scissors and payweight.

First, as to the offset forcing points, Ross mentions that his primary hydraulic cylinder acts on "off-set torque-lugs", apparently to aid mechanical advantage near the fully retracted position. From his drawings it appears that each forcing point is spaced from the rotational axis of the bottom of the respective leg by nearly half (about 0.46) of the length of the leg, and is offset approximately seventeen degrees (about the rotational axis) from the respective leg. The magnitude of these values has certain significance, which will be discussed later.

Second, as in Paul's cable-extended device, the auxiliary driving mechanism of Ross's hydraulic system—namely, Ross's vertical auxiliary cylinder—is provided:

> "owing to the dificulty encountered at the point of substantially zero lift when the carriage . . . is in its lowermost position . . . [W]hen the upward travel of the carriage is initiated, the two piston-rods]. . . aid the main cylinders and their piston-rods until the limits of travel of the former have been reached at which time the main hydraulic means will be in such angular relation as to be properly effective to complete the lifting movement of the carriage.
>
> "Stated somewhat otherwise, the primary use of these 'booster' or supplementary, upright, hydraulic means is to aid the 'breaking' or starting of the upward motion of the pantograph-linkages . . . ."

Thus the auxiliary device is not intended to serve any function relating to operation in the extended position of the scissors.

Furthermore, when the apparatus is to be lowered from the extended position, this function "is accomplished in the usual manner by means of release valves of conventional design . . . ." In other words, the primary driving force is removed, and the weight on the platform lowers the scissors.

Moreover, also paralleling the cable-driven scissors disclosures, Ross's hydraulic unit deals with the variation of mechanical advantage in the midrange and extended positions of the scissors simply by supplying the varying force required to support the payweight.

Another patent in this area is U.S. Pat. No. 3,750,846, which issued Aug. 7, 1973, to Thomas Huxley. This patent discloses a multistage scissors that is driven either by an electric motor in combination with a screw or by a hydraulic cylinder. The first stage of the scissors in Huxley's device is not driven by pulling or pushing the legs together, but rather by pushing straight outwardly on the center pivot of the first stage. Nevertheless, the first stage necessarily extends the second stage by pulling the legs of the second stage together, so the previously discussed problems of mechanical-advantage variation are not completely eliminated. Due to play in the mechanism, the tendency for the outer stages to bind is as serious in Huxley's device as in those of Wichertjes and Munns.

Huxley responds to this difficulty by providing a separate device for boosting the last stage of the scissors out of its retracted or folded condition. This device is a spring which is compressed by a small part of the travel of the last stage during retraction—that is, just the last fifth or fourth of the travel. The spring stores the compression energy, and is sufficient to carry the full load of the payweight basket; it tends to drive the last stage out of the fully retracted condition. This tendency, however, is offset by the retracted condition of the adjacent stages of the scissors.

The tendency to extend the last stage, however, is used when the time comes to extend the entire mechanism. In effect, as Huxley explains, "Unfolding forces . . . commence at opposite ends of the boom structure and work towards the center . . . greatly facilitating the successive opening of the crossed links beyond critical angles . . . " The critical angles of which Huxley speaks arise, apparently, from distortion of the individual links, rather than from driving geometry.

Like the patents previously discussed, Huxley's is concerned with unfolding of his scissors mechanism from its fully retracted condition. Inspection of Huxley's disclosure reveals no passage directed to the detailed operation of the mechanism when it is extended (d) Scissors Mechanisms: Other Factors—The Munns, Paul and Huxley patents represent a "second generation" of developments in the scissors-mechanism lift field. They are directed to producing optimum performance in terms of reliability and convenience.

Modern users of equipment, however, demand more than this. The present age is extremely conscious of the usage of energy, particularly nonrenewable energy sources. The modern age is also extremely conscious of the usage of materials, particularly metals, and of hand labor. It is furthermore extremely conscious of the usage of space, since the per-square-foot cost of usable home, office, and even light industrial space has skyrocketed in the last decade. Even the weight of equipment itself can be a critical factor, since shipping cost and ease of installation depend on this characteristic.

It has therefore become a matter of paramount concern to all manufacturers, and certainly to manufacturers of lifts intended for high-volume manufacture and for use in expensive home and business square footage, that apparatus be efficient in terms of labor, energy usage, space, materials, and shipping weight—while the equipment remains just as reliable and convenient as before.

Perhaps less plain, but equally significant in terms of energy and materials efficiency, is the undesirability of making several different models of lifts for use with articles of different weights—or, in other words, for different "payweights". It is desirable to standardize as much of a lift mechanism as possible, leaving a bare minimum of different submodules that must be changed to accomodate different payweights.

The use of different payweights arises from the infinitely various types of articles which end-users may wish to see repetitively raised and lowered. Thus it is neither possible nor particularly desirable to eliminate nonuniformity of payweights in use.

Yet there are many inefficiencies in the practice of manufacturing substantially different lifts for different payweights. Such inefficiencies extend through warehousing, spare-parts maintenance, billing and bookkeeping systems, and communications complexity all along the distribution chain from manufacturer to user.

(e) Energy-recycling Systems: General Introduction—In another field, the field of mechanical energy-storage devices, certain basic developments have arisen which have never been used in scissors lifts. It is not clear whether it has ever previously occurred to anyone skilled in the art of lift mechanisms to attempt to provide a scissors mechanism in combination with an energy-storage device, to recycle the energy released in lowering a payweight for the purpose of raising the same payweight subsequently.

One special kind of energy-storing lift that has been developed is a vertically acting cable-counterweighted lift, similar to an elevator or dumb waiter. This type of device does not involve a scissors mechanism. The energy in this type of device is stored as potential energy of height of the counterweight. Such devices, as previously noted for cable-driven scissors lifts, are disadvantageous by virtue of the need for several pulleys and the need to thread cables correctly. The resulting cost and labor requirement makes such devices undesirable in comparison to a scissors lift.

Thus the energy-storage approach has distinct appeal for use in scissors lifts.

(f) Energy-recycling Systems: Springs—One basic energy-storage device is of course the common mechanical spring. Springs are used in a wide variety of applications to "balance" various kinds of objects that are repetitively moved: the general goal is for the spring generally to support the object, while relatively small forces are supplied externally to move the object.

As is familiar to almost everyone in modern society, this goal is only marginally reached. The most common example is the spring suspension of horizontally pivoted (that is, vertically acting) doors, and particularly garage doors. The pervasive commercial success of automatic openers for garage doors is, in part, testimony to the incomplete ability of springs to balance large, heavy objects throughout their complete operating range.

The reason for this limitation apparently resides in the typical force-versus-travel characteristic of a spring: the force varies quite steeply with displacement (as a fraction of spring length) from the at-rest position of the spring. Suspension of a heavy object through a long displacement consequently requires use of a very long spring (so that the displacement can be made a relatively small fraction of the spring length). Thus garage-door suspension springs, despite clever use of mechanical linkages to minimize the necessary spring displacement, are typically three or four feet long.

Another disadvantage of springs is that if they break or lose their anchorage and whip around—or even if they are used with inadequate planning for unexpected release of the spring-driven mechanism—they can cause severe damage or injury. Garage-door suspension springs are at least favorably positionable on the opposite side of the door from the person moving the door, but this advantage is not available in many applications where it might be desirable to install lifts.

These limitations are particularly salient in the field of cabinetry lifts for indoor use, since space is at a distinct premium and it is difficult to arrange a single spring with sufficient travel to suspend a heavy object. The limitations of springs are also salient in this same field, and in the broader field of repetitively acting lifts, since in these fields it is typical for valuable and relatively fragile objects to be positioned—and for personnel to work—near the mechanism on a regular basis.

It is undoubtedly for these reasons that energy-recycling scissors lifts using springs are unknown. Even linearly, vertically acting lifts or jacks relying upon springs to recycle energy are not in common use, although they have been in the patent literature for many years. U.S. Pat. Nos. 727,192 (issued May 5, 1903 to Olen Payne) and 3,007,676 (issued Nov. 7, 1961 to Laszlo Javorik) each describe a vehicle jack with a spring that is compressed beforehand, storing energy for use in raising a vehicle. Mere brief speculation on the workings and typical uses (and users) of such articles suffices to explain their commercial nonexistence.

(g) Energy-Recycling Systems: Gas Cylinders—A recent innovation commercially is the permanently sealed gas cylinder, which contains a fixed quantity of gas (subject to very slight leakage, over a service period of several years) and which exerts an outward force on a piston. These gas cylinders are to be clearly distinguished from the earlier and better-known pneumatic and hydraulic cylinders that must be connected through valving to pressure sources—such as compressors, compressed-gas tanks, or pumps (as in the Ross patent).

An interesting aspect of these devices is that the force-versus-travel characteristic can be, and almost always is, made extremely shallow. In fact, the force is usually made very nearly independent of varying position of the piston, over the operating range of the apparatus in which the cylinder is installed. In this way practically constant force is made available for the purposes of the apparatus. A manufacturer of these gas cylinders is the West German firm Suspa-Federungstechnik GmbH, of Altdorf.

Each cylinder contains a small amount of oil, in addition to the driving gas, for the purpose of lubricating the action of the piston in the cylinder—and also for the purpose of controlling the speed at which the piston reacts to changes in adjustment or externally applied forces.

These cylinders have been used in such applications as supporting automobile hatchbacks and controlling office-chair seat heights. As can be readily understood, the shallow force-versus-travel characteristic of the devices is quite useful in such units. In some units for use in office chairs, the force-versus-travel curve for these devices is modified by changing the amount of oil, or in other ways, to superpose a relatively steeply rising segment at short cylinder extensions. Doing this provides a cushioning effect as users of the chairs sit down.

If it ever previously occurred to anyone to use such cylinders in connection with cabinetry lifts generally or with scissors lifts in particular, the idea would very likely be dismissed out of hand, for reasons to be set forth in the discussion of the invention.

(h) Summary: The foregoing comments show that there has been a need in the cabinetry-lift industry for a third generation of scissors lifts, one that is (1) substantially more compact, simpler in construction, and lighter in shipping weight than those of the second generation but (2) at least as convenient and reliable, and (3) capable of accommodating any payweight with minimal change of components. This need arises from considerations of energy, labor and materials efficiency, and efficiency in general, and also from considerations of reliability in use.

These comments also show that the concept of (4) recycling the energy used in repetitive raising and lowering of the payweight has some tantalizing benefits for the scissors-lift industry, but that this concept has never been applied to scissors lifts.

SUMMARY OF THE INVENTION

The present invention is directed to a third generation of scissors-lift equipment. It provides an efficient, lightweight, energy-recycling lift, which therefore requires essentially no power to operate. Nevertheless it is just as sturdy as previous lifts, is at least as compact and convenient, and is substantially faster, simpler and quieter.

Moreover, this invention makes it possible for just one lift model to be used for virtually any payweight, with a simple, easily effected change of just one component, an improvement which produces very significant economies in construction, warehousing, distribution and maintenance, as well as giving users more options for the use of their equipment.

The lift of this invention has the following elements in combination, for use in repetitively raising and lowering an article.

One element is a scissors mechanism, arranged for vertical extension—or substantially vertical, since it need not be precisely so—to support such an article. The scissors mechanism includes a base that is adapted to rest upon a support surface, and a platform that is adapted to support and to bear the weight of such an article.

If the lift is permanently dedicated to the article, the platform can be manufactured as part of the article itself. In such situations the platform need not be a customary planar platform structure but may be, generally speaking, part of the framework or chassis of the article to be supported.

The scissors mechanism also includes a scissors-type linkage interconnecting the base and the platform. By a scissors-type linkage is meant a mechanism that has two legs pivoted together near their centers by a pivot pin or the like, with the legs arranged to be drawn or otherwise driven together (or apart) at or near one end, and also arranged to transmit the driving force to their other end. Commonly a scissors-type linkage has two such leg pairs disposed adjacent each other, to support an article three-dimensionally rather than only two-dimensionally, but other provisions for three-dimensional support are within the scope of the invention.

In accordance with this invention the scissors-type linkage is adapted to exert upward force upon, and thereby to support, the platform and such an article on the platform. The scissors-type linkage is also adapted to maintain the platform substantially horizontal regardless of the height of the platform above the base. These adaptations need be made effective only within the operating range of the mechanism, which typically does not reach a fully extended condition of the scissors.

In addition to the scissors mechanism, another element of the invention is some mechanical means for energy storage. These mechanical energy-storage means are secured to the scissors mechanism in some way.

Yet another element of the invention is some means for repetitively receiving energy derived from retraction of the scissors mechanism—that is, from lowering of such an article—over the entire operating range of the mechanism, and for storing this energy in the energy-storage means. In other words these energy-receiving-and-storing means serve as an intermediary between the scissors and the energy-storage means, passing the potential energy of the elevated article (and the platform) to the energy-storage means, as that energy is released in descent.

The same energy-receiving-and-storing (or intermediary) means also repetitively apply energy from the energy-storage means, for use in reextending the mechanism to its maximum extension (again, within the operating range for the overall apparatus). Through the scissors mechanism, energy drawn from the energy-storage means is made to bear the combined weight of the platform and such an article on the platform, for the raising of the platform and of such an article.

The phrase that has just been used, "bear the combined weight . . . for the raising", is intended to describe any of several situations. First, it includes the situation in which the energy from the energy-storage means produces an upward force at the platform which exceeds the platform weight plus payweight, when the scissors is retracted (though not necessarily at all positions of extension), so that the energy-storage means is capable of starting the payweight upward.

In this situation the mechanism typically must be held down by a small mechanical catch or the like, or by a small electrical motor or a small hydraulic or pneumatic cylinder, externally driven—and this hold-down provision must be released to initiate the upward motion. The energy available from the storage means must be coupled to the mechanism by the receiving-and-storing means in such a way that the mechanism, once started upward, will continue to its maximum extension within the operating range. This may be accomplished by having the resultant force exceed the payweight plus platform weight at these positions:

(a) at all points in the operating range; or (b) in and near the retracted position, and in the extended position, but not at all intermediate positions—in which case upward travel through the intermediate positions is effectuated by upward momentum gained near the retracted position; or (c) in and near the retracted position, but not at the extended position—in which case upward travel all the way to the extended position is effectuated by upward momentum gained near the retracted position, but the mechanism once having reached the extended position would descend if permitted, and so must be held at the top by some otherwise applied force, as for example by a mechanical catch.

In cases a and b the payweight and platform must be started down by applying downward pilot force, as by a user's pressing downward on the article or by application of force from a small, remotely controlled motor, or conventional hydraulic or pneumatic cylinder. In case c it suffices to release the catch, or otherwise remove the restraining force applied.

There is a second group of situations included within the phrase "bear the combined weight . . . for the raising": here the energy-storage means almost—but not quite—produces a platform force sufficient to start the mechanism upward. Only a relatively small increment of pilot force is required to begin the motion. Once the motion is begun and has proceeded through a range of positions near the retracted position, again it may continue to the top of the operating range even though the pilot force is discontinued, or it may be made to require continued application of pilot force, depending upon the constraints of the particular use and the preferences of the designer or user. These upward forces may be provided manually by a user or by the action of a small motor or externally driven cylinder, as before.

Yet a third group of situations is meant to be covered by the phrase under discussion. In these situations the mechanism starts up by itself—when the downward-restraining provision is released—but at some part of the operating range the net upward platform force is less than the payweight plus platform weight, and there is inadequate momentum to continue the motion. Therefore the motion ceases partway up and must be continued by upward pilot force applied in the ways previously described.

To make it more clear that the energy-storage means need not positively support all of the combined weight of platform and article, the word "substantially" or the word "generally" is used in certain of the appended claims before "bear the combined weight" or like phrases. In other claims the resort to pilot forces has been made explicit.

As previously pointed out, a scissors mechanism has a mechanical advantage, relative to the weight of such an article on the platform, that varies strongly over the operating range. The mechanical advantage varies, in fact, as the tangent of the leg angle, if the driving force is applied to pull the driven ends of the legs straight toward each other. When other driving geometry is used, the variation may not go as the tangent, but generally is strong.

The combination of my invention accordingly also includes some means for at least partly compensating for the variation of the mechanical advantage. This compensation, in accordance with my invention, is such that the upward force exerted upon the platform by the energy-storage means, through the scissors mechanism, generally bears the combined payweight and platform weight in both the retracted and extended positions of the scissors, with at most a small overforce in the extended position. This arrangement makes it possible to lower the mechanism from its extended position with, at most, a small downward pilot force.

Emphatically this compensation requirement is far more demanding than the "booster" provisions of the prior art, since in connection with the present invention it is not enough simply to aid the scissors lift out of the range of positions near the retracted position. It is also essential to equalize the lifting force which the energy-storage means exert at the platform in the extended position with that exerted in the retracted position, to the extent that there is only a small fractional difference between the two.

Only if this is done will a user (other than a very strong and in some cases very heavy user) be able to start the mechanism downward from its extended condition. This attention to operation in the extended position is not found in the prior art, and is unique to my invention. It arises because in accordance with my invention the energy-storage means which provide the primary lifting force for the greatest fraction of the operating range of the lift are always functionally connected to the lift. Contrary to the prior art the primary lifting force of my invention is never disconnected, reduced by external controls, or reversed.

(As will be seen, one way of implementing the desired compensation involves the use of parallel plural devices forming the energy-storage means, and parallel plural devices forming the energy-receiving-and-storing means. Some of these parallel devices in effect disconnect themselves by running out of travel, but the storage and receiving-and-storing means considered as a unity remain always connected since at least some part of them is always connected.)

The compensating means thus make possible the use of the energy-storage means to facilitate repetitive raising of such an article without repetitive provision of energy from any source outside the combination—except for small amounts of energy, pilot energy, expended by the user to control the direction of operation of the mechanism.

In one preferred embodiment of the invention a single, permanently sealed gas cylinder is used as the mechanical energy-storage means.

Interestingly enough, the gas cylinder's relatively shallow force-versus-travel characteristic, which is so useful in the normal usages of these devices, is actually at first blush problematical in the present usage. The cylinder force characteristic is typically very flat, or nearly constant, while the mechanical advantage of the scissors varies very strongly. If a gas cylinder in the normal configuration were made forceful enough to raise a payweight from the collapsed position of the scissors, an extremely high level of force would be exerted on the payweight at the extended position.

This large force would be excessively difficult to overcome for the purpose of lowering the payweight from the extended position. It is for this reason that persons skilled in the art of scissors-lift design would tend to dismiss out-of-hand the possibility of driving a scissors lift with a gas cylinder. (The extreme nature of this discouragement will be shown through some examples in the detailed description of the invention which follows.)

The invention includes, however, a way of including the compensating means mentioned above within such a single sealed cylinder, so that the cylinder force-versus-travel characteristic just complements the mechanical-advantage function of the scissors. This inclusion of the compensating means within a single gas cylinder is also part of the preferred embodiment of the invention.

The preferred embodiment also includes provision of assistance of the compensating means, in the form of improved offset-forcing-point geometry. Improvement relative to the offset geometry suggested by Ross is highly desirable, because Ross's geometry is directed only to providing a "boost" at the retracted position, whereas mine must promote a more demanding mechanical behavior in the extended position.

In its other embodiments, however, the invention also encompasses other forms of mechanical energy-storage means, including springs; and other forms of compensating means, including one or more additional, parallel cylinders or springs. All these embodiments will be described in some detail below.

All of the foregoing operational principles and advantages of the present invention will be more fully appreciated upon consideration of the following detailed description, with reference to the appended drawings, of which:

DETAILED DESCRIPTION OF THE PREFERRED EMBODIMENTS

Figure 1:
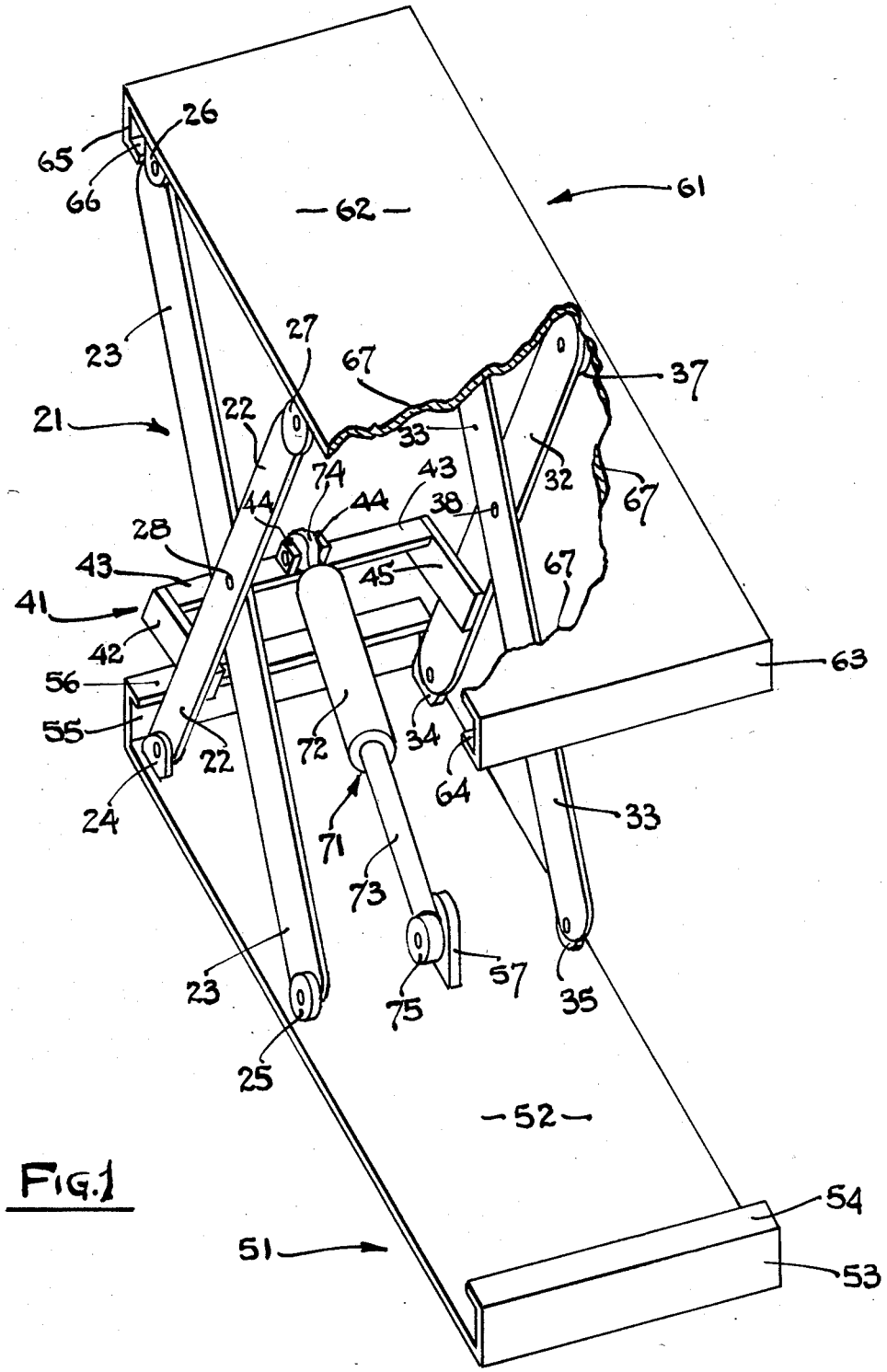
FIG. 1 is an isometric view of a preferred embodiment of the present energy-recycling scissors lift invention, in which the energy-storage means is a sealed gas cylinder. The lift is shown extended, and its upper platform is drawn partially broken away for a clearer view of the mechanical details.

As shown in FIG. 1, certain preferred embodiments of my invention have a scissors mechanism, generally shown at 21, 51 and 61, in combination with an energy-storage device that takes the form of a sealed gas cylinder 71.

Also part of the combination is an intermediary structure 41 that serves as means for repetitively receiving energy derived from retraction of the scissors mechanism, and for storing this energy in the energy-storage means. These energy-receiving-and-storing means—the bridge structure 41—serve as an intermediary between the scissors and the energy-storage means, passing the potential energy of the elevated article to the energy-storage means, as that energy is released in descent. The intermediary structure 41 also, as previously mentioned, passes the stored energy back to the scissors mechanism for use in raising the scissors and its load.

The scissors mechanism consists of a base 51, a platform 61, and a scissors-type linkage 21 interconnecting the base and platform. An article 86 (FIGS. 2 and 3) to be repetitively raised and lowered is placed on the platform 61, and may if desired be secured to the platform.

The base 51 is advantageously made as a unitary piece of fairly heavy-gauge metal, most of which rests horizontally on a supporting surface to form a floor section 52. The metal is bent upward at both ends, however, to form stabilizing corner edges. The resulting upright end pieces 55 and 53 are further bent inward to form short horizontal sections 56 and 54, respectively, to avoid exposed metal edges at the tops of the upright end pieces.

Welded or otherwise suitably attached to the base floor section 52 near its opposite edges, and near one upright end piece 55, are upright end bosses 24 and 34 for pivotal attachment of the scissors legs 22 and 32 respectively. Also welded or suitably attached to the base 52 near its center is another upright boss 57 for pivotal attachment of one end of the gas cylinder 71.

The platform, very similarly, is made as a unitary piece of sheet metal, most of which is formed as a horizontal section 62—drawn partly broken away at 67 to permit a fuller view of the mechanism below—with downward end pieces 65 and 63, and short inward horizontal sections 66 and 64, respectively. Welded or otherwise suitably attached to the undersurface of the platform are bosses for pivotal attachment to the tops of the scissors legs 23 and 33; one of these bosses is shown at 26 in the drawings, the other being out of sight beneath the far corner of the platform 61 in FIG. 1.

Sheet metal one-sixteenth to three-thirty-seconds of an inch thick is adequate as both the base 51 and platform 61 for most purposes, with proper design. During operation very large forces, as large as two to four times the weight of the article on the platform, arise within the mechanism, particularly including the base 51 and particularly when the platform is nearly retracted. It is essential to provide suitably strong material, and if necessary suitable reinforcement, to safely accommodate these forces. In this regard, for heavier payweights both the base 51 and the platform 61 are advantageously also provided with upwardly bent side pieces (not illustrated) to provide stabilizing edges along both sides of the long dimension of the base 51 and platform 61.

It is no more than a semantic question whether the bosses 24, 34, and 26, and the concealed boss mentioned above, should be regarded as parts of the base 51 and platform 61 or as parts of the scissors-type linkage 21. These bosses are in any event pivotally connected to the lower ends of the scissors legs 22 and 32, and to the upper ends of the scissors legs 23 and 33, respectively. The pivotal connections here—and others to be mentioned—may be made using pinned or circlipped axles riding in bushings, or by bolts and nuts, or by rivets, or by other means appropriate to the desired quality and performance of the finished product.

The scissors legs 22 and 23 at one side of the mechanism are pivoted together near (but not necessarily at)

their centers, using a pivotal connection 28. The legs 32 and 33 at the other side are likewise pivoted together by connection 38. Pivotally connected to the lower ends of the legs 23 and 33, and to the upper ends of the legs 22 and 32, are respective wheels 25, 35, 27 and 37. The lower two wheels 25 and 35 roll along the upper surface of the base flooring 52, and the upper two wheels 27 and 37 roll along the undersurface of the platform horizontal section 62.

In the usual fashion of a scissors or pantograph mechanism, the lengths of the legs 22, 23, 32 and 33 and the pivoting arrangements are all selected and disposed to support the platform horizontal section 62 in fact horizontally—or substantially horizontally—as the scissors extends and retracts.

The sealed gas cylinder 71 consists of the cylinder proper 72, with piston rod or shaft 73 sliding in and out through an aperture in one end of the cylinder proper 72. The piston itself is entirely within the cylinder proper, the shaft is generally hollow, and there are a number of internal passageways within the cylinder proper 72 and the shaft 73. These internal passageways are used to control the flow of gas and oil, and thereby to control many of the static and dynamic characteristics of the cylinder 71. These particulars are not part of the present invention, being well developed and publicized through the efforts of personnel such as those of the Suspa firm mentioned earlier.

The use of the finished gas cylinders with these particulars selected and adjusted to serve the purposes of the energy-recycling scissors lift, however, does form part of some embodiments of the present invention. Some details in this regard will be presented below.

The end of the shaft 73 that is remote from the piston is formed as, or firmly secured to, an eyelet 75, and this eye is pivotally secured to the base flooring 52 by means of the floor-mounted boss 57. Similarly the end of the cylinder proper 72 that is remote from the shaft 73 is integrally formed with, or firmly secured to, another eyelet 74. This eye 74, similarly, is pivotally secured to the intermediary bridge structure 41.

Figure 2:
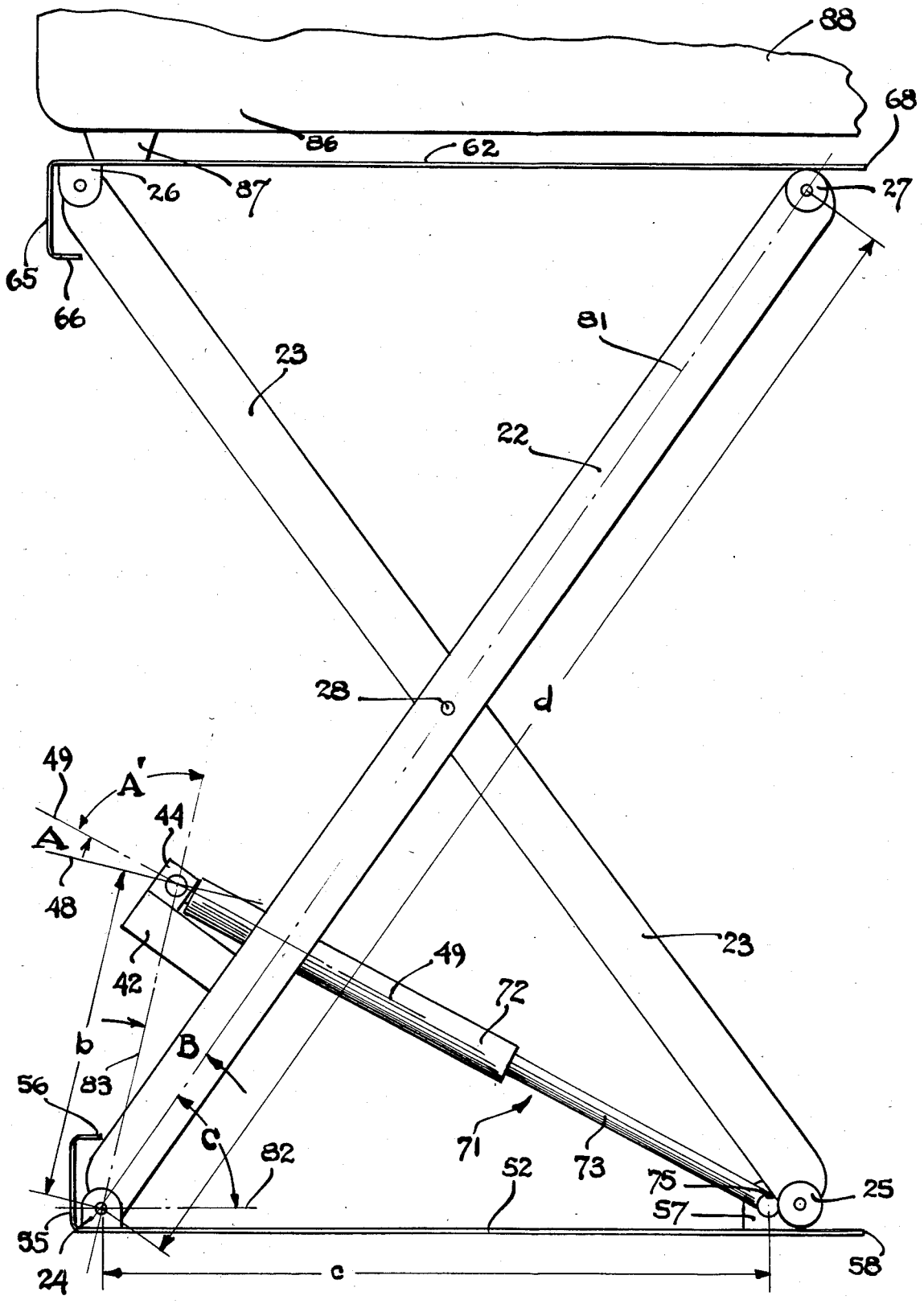
FIG. 2 is a side elevation of the same embodiment, also showing the lift extended (or "unfolded" or "raised"), and indicating the definitions of certain algebraic quantities used in analyzing the behavior of the invention.
Figure 3:
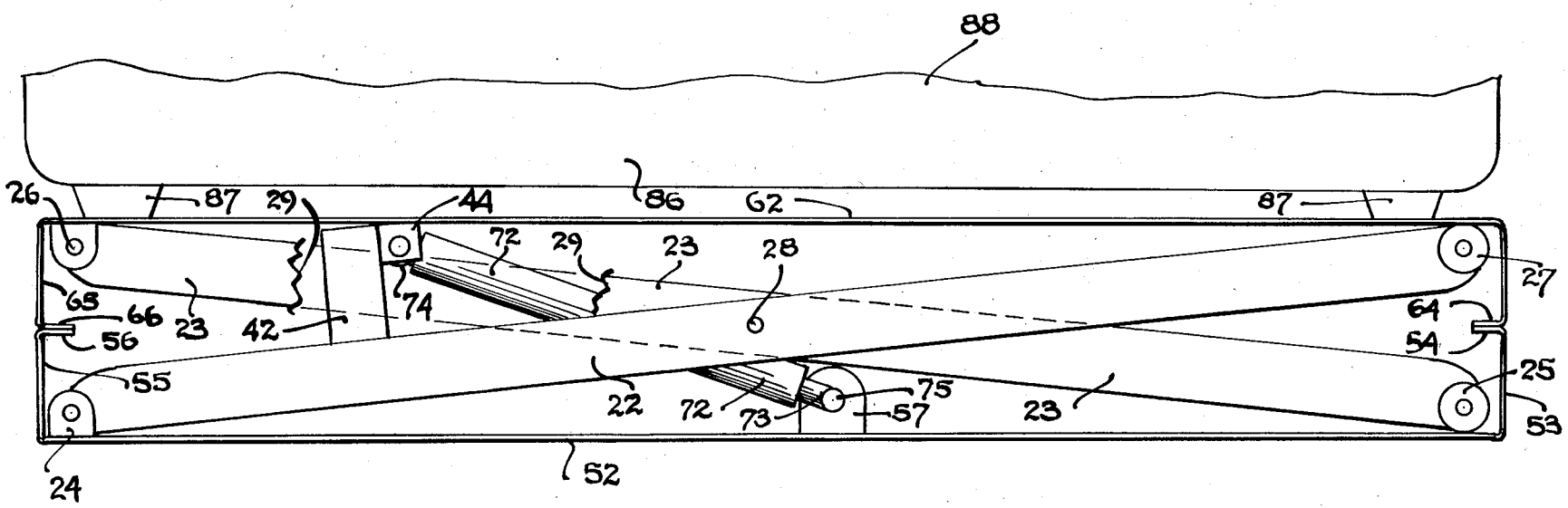
FIG. 3 is a similar view of the same embodiment, but showing the lift retracted (or "folded" or "collapsed"). One leg of the scissors is shown partly broken away for a clearer view of the mechanism behind it; and for the sake of clarity in that same area the corresponding leg at the rearward side of the lift is not illustrated.

Most of the components just identified appear in FIGS. 2 and 3 as well as FIG. 1. Also defined in FIG. 2, however, are some parameters of the energy-recycling scissors lift which are useful in analyzing the behavior of the system. In particular, the line of pivot centers 81 in the driven leg 22 makes an angle C with the horizontal line 82 (that is, the line 82 that passes through the center of the lower pivot of the driven leg 22 and that is parallel to the base flooring 52). The line of pivot centers 81 makes another angle B with the line 83 that connects the center of the lower pivot of the driven leg 22 with the center of the forcing-point pivot. Angle C may be conveniently called the scissors angle; and angle B, the forcing-point offset angle. Both these angles are to be considered positive as illustrated.

The centerline 49 of the gas cylinder 71 also intersects the above-mentioned line 83—which connects the driven-leg pivot with the forcing-point pivot—in an angle A'. The complement A of this angle A' defines what might be called the error angle between the line 49 of force application by the gas cylinder 71 and the tangent line 48 of the arc which the forcing point 44 makes about the lower pivot of the leg 22. The mechanical advantage of this portion of the mechanism is best when this angle A is zero—that is, when force is applied along the tangent line 48—and it decreases as the mechanism moves to either side of that optimum position. For the purposes of the present discussion the error angle A will be considered positive when the scissors is fully retracted, and for small angles of extension; consequently it is negative after the mechanism has passed through the optimum position, as it has in the illustrated condition.

Also defined in FIG. 2 is the baseline c, which is the horizontal distance between the lower pivot of the driven leg 22 and the piston rod pivot 75; and the forcing-point radius b, which is the distance along the previously mentioned line 83 that joins the forcing-point pivot and the lower pivot of the driven leg 22. Moreover, the drawing also illustrates the leg length d, which is the distance between the centers of the two end pivots of the driven leg 22; in principle the interpivot lengths of the other three legs 23, 32 and 33 should be the same as this length d.

At the outset it should be noted that the best compensation or equalization results from large values of mechanical advantage at small scissors angles C. Large mechanical-advantage values in turn are produced by using a relatively large forcing-point offset angle B and/or a relatively large forcing-point radius b. Unfortunately, however, for a single-stage scissors, the larger the value for offset angle B and radius b the higher must be the platform 62—when the scissors is fully retracted—to clear the lugs 44. This constraint may be seen from FIG. 3 (in which the leg 23 is shown broken away at 29, for a plainer view of the bridge arm 42, lugs 44, cylinder 72, and eye 74). In cabinetry lifts it is typically very important to minimize the height of the platform 62 when the scissors mechanism is fully retracted, and to maximize the vertical stroke of the platform.

Consequently the offset angle B and radius b must be chosen as compromise values which yield reasonable mechanical-advantage equalization. According to the present invention it has been found to be a particularly advantageous compromise to make the offset radius around a quarter of the leg length d, and the offset angle B around twenty to twenty-five degrees. Although these parameters were chosen essentially by a process of educated trial and error, the general effects may be seen from an algebraic analysis of the apparatus.

The mechanical advantage which the mechanism gives the gas cylinder, against the vertically acting weight of the platform 62 and its payweight 86, is:

$$\frac{b \cos A}{d \cos C} = \frac{b \cos \left[ \tan^{-1} \frac{\cos (B + C) - b/c}{\sin (B + C)} \right]}{d \cos C}$$

Figure 4:
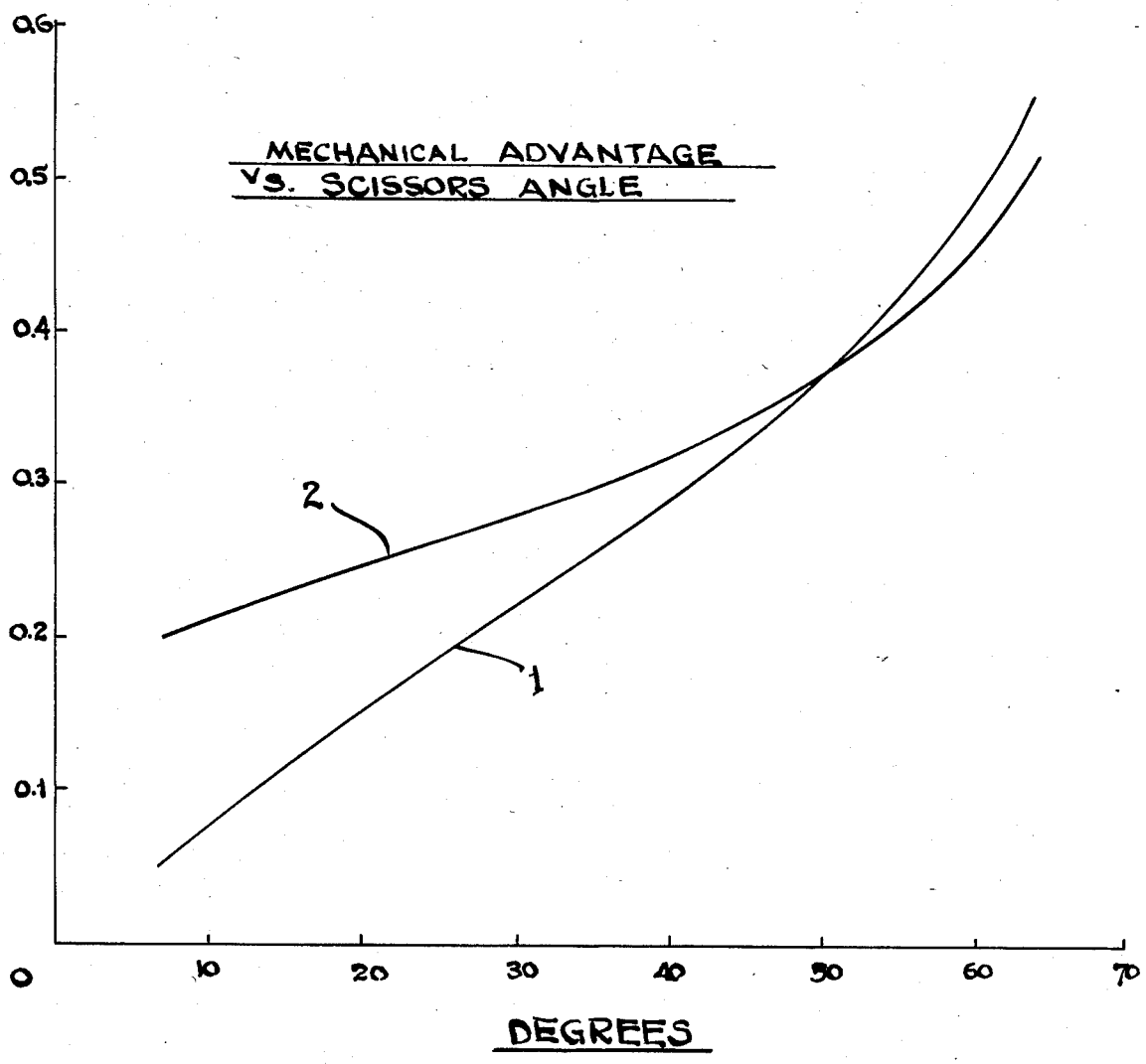
FIG. 4 is a graph showing the mechanical advantage which the gas cylinder of FIGS. 1 through 3 has on a weight placed on the platform for a certain configuration—that is to say, for a certain combination of dimensions that is described in the text. The graph shows calculated mechanical advantage as a function of scissors angle. The configuration is one of the preferred embodiments of my invention, though not the most highly preferred. The mechanical advantage is also shown for another embodiment of the invention which is not a preferred one but which is discussed in the text.

If the leg length d is chosen as 29.75 inches, the base length c as 15.625 inches, and the forcing-point radius b as 7.25 inches (or the ratios between these three values are preserved while the absolute values are increased or decreased), the effect of varying the forcing-point offset angle B can be seen from FIG. 4. In this graph, curve 1 shows the calculated variation of mechanical advantage (dimensionless) with scissors angle C (in degrees) for a forcing-point offset angle of zero. In other words, this curve results from assuming the forcing point to be along the line of pivot centers 81 in FIG. 2.

The most salient features of curve 1 in FIG. 4 are its steepness and the very large range of mechanical-advantage values which it spans—from 0.06 at scissors angle of seven degrees to 0.56 at sixty-four degrees, a dynamic range of more than nine. That is to say, the mechanical advantage changes by a factor exceeding nine, over the operating range of such an apparatus.

The operating range here has been defined as seven to sixty-four degrees because the resulting range of platform heights (using the dimensions mentioned earlier) is satisfactory for a wide variety of cabinetry lift applications—though there is always a desire to provide even greater platform stroke, and thereby to encompass even other applications.

Now suppose that a gas cylinder is selected—or that a permanent gas charge for such a cylinder is selected—so that the force at the piston is just large enough to generally bear the combined weight of the platform and an article upon it when the scissors angle is seven degrees. This means that 0.06 times the piston force approximately equals the combined weight of platform and payweight. Another way of saying this is that the piston force must be chosen to equal the combined weight divided by 0.06. If the force at the piston were unchanging with cylinder extension—and consequently unchanging with scissors angle—then the upward force on the platform at sixty-four degrees would be 0.56 times the same piston force. Combining the last two statements, the upward force on the platform at sixty-four degrees scissors angle would be:

$$\frac{0.56}{0.06} \times \text{(combined payweight and platform weight)}$$

or 9.3 × (combined weight).

Now if the combined weight equals, say fifty pounds, then the upward force on the platform at the extended position of the scissors (sixty-four degrees here) would be some 465 pounds. Allowing for the downward force due to the weights, the net or excess upward force on the platform—the "overforce," in short—would be around 415 pounds. Few human beings alive would be able (without some added source of weight or other force, or some separate provision for leverage) to push the lift down from the sixty-four-degree position.

Practical payweights range to 150 pounds and more. Such payweights would entail extremely high platform forces at the extended position, up to 1400 pounds (with "overforce" of 1250 pounds), and these would be even more impossible for a user to lower. The essence of the equalization problem discussed earlier should now be clear.

Curve 2 in FIG. 4 shows the behavior of the mechanical advantage if the forcing-point offset angle B (FIG. 2) is made about twenty-five degrees. (The actual value used in the calculations was 24.7 degrees.) This curve is much flatter than curve 1; it ranges only from 0.2 to 0.52, a dynamic range of about 2.6 (instead of 9.3). Consequently if the gas cylinder (or its charge) were selected to bear the combined platform weight and payweight at scissors angle of seven degrees, the upward platform force at sixty-four degrees would be only:

$$\frac{0.52}{0.20} \times \text{(combined weight)}$$

or 2.6 × (combined weight).

Now it can be seen that for a fifty-pound combined weight, the upward force is only about 130 pounds (instead of 480), and the "overforce" is only about eighty pounds (instead of 430). Accordingly, it is now nearly within the realm of practicality for many users to lower the lift from its extended position. The equalization problem has at least been seriously reduced, or partially solved. For larger combined weights the problem remains quite serious, since a cylinder suitable for a 150-pound combined weight would generate an "overforce" of 240 pounds, which is really impractical for most housewives and most office workers to lower.

The residual aspects of the equalization problem are in part due to the fact that the forcing-point offset angle B and radius b cannot readily be increased—to further flatten the mechanical-advantage curve—because of the problem of interference with the platform in the retracted position, as already mentioned.

Figure 5:
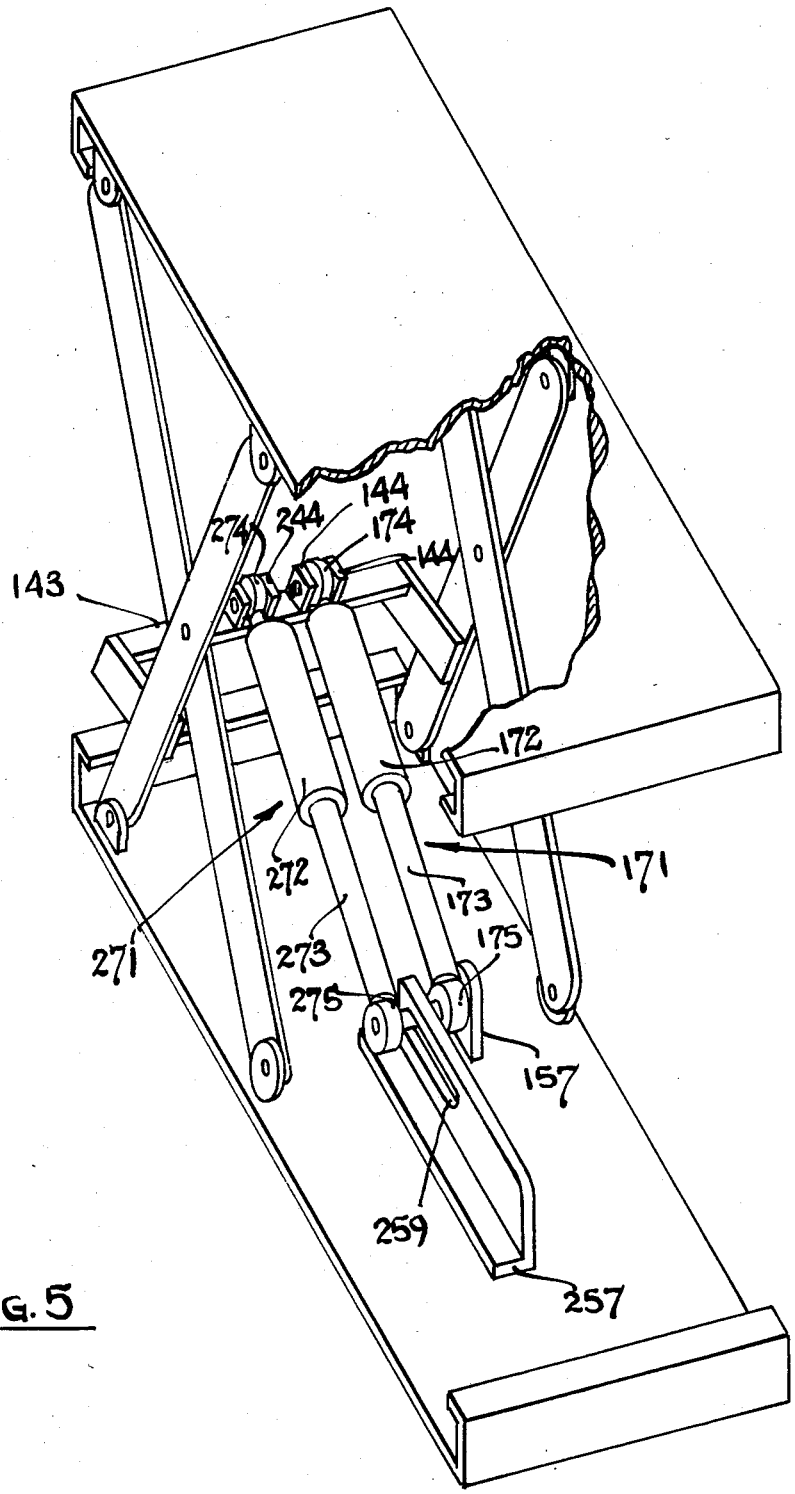
FIG. 5 is an isometric view (similar to that of FIG. 1) of another embodiment of my invention, which incorporates an equalizing or compensating gas cylinder in addition to the primary cylinder of FIGS. 1 through 3.

The present invention encompasses several ways of dealing with the residual problem. FIG. 5 shows another embodiment of the invention, which offers one such way. Most of the components are just the same as in FIGS. 1 through 3 and will not be described again here. The gas cylinder 71 of those earlier drawings is essentially the same as cylinder 171 in FIG. 5, except that it is moved to the side to make room for a second cylinder 271.

This second cylinder is an equalizing or compensating cylinder, which is arranged to add lifting force only at small scissors angles—so that the total platform force at small angles (that is, in and near the retracted position) can be generally equal to the total platform force at large angles (that is, in and near the extended position). The equalizing cylinder 271 has a cylinder section proper 272 generally similar to the corresponding cylinder proper 172 of the primary cylinder 171 (and to the corresponding cylinder proper 72 of FIGS. 1 through 3). The equalizing cylinder 271 also has a piston-rod section 273 that is generally similar to the corresponding feature 173 of the primary cylinder 171.

The equalizing cylinder proper 272 has an eyelet 274 (like the eyelet 174 of the primary cylinder), which is attached to the bridge structure 143 by lugs 244 that are similar to (and next to) the lugs 144 for the primary cylinder. Thus the two cylinders drive the bridge, and thereby the scissors, in parallel.

The equalizing-cylinder's piston-rod pivot or eyelet 275, however, is not pivotally mounted to a fixed boss as is the corresponding structure 175 of the primary cylinder 171. Rather the pivot or eye 275 is mounted for sliding motion, as well as rotation, to a slotted angle iron 257 or the like. The pivot 275 engages the remots end-wall of the slot 259—that is, the end of the slot that is forward and to the right in FIG. 5, remote from the bridge structure 143—when the scissors mechanism is in or near the fully retracted position. When the scissors mechanism is retracted or nearly so, the piston and piston rod 273 of the equalizing cylinder 271 are accordingly driven at least partway into the cylinder proper 272, producing a force which tends to extend the scissors mechanism.

After the scissors has extended by some predetermined amount, however, the equalizing-cylinder piston rod 273 will have moved by its entire travel outwardly from the cylinder proper 272. Further motion is precluded by internal abutment of the piston within the cylinder proper 272, against the end-wall of the the cylinder proper 272. Accordingly no further force is generated as between the bridge and the slotted angle 257; to avoid the stopping of the mechanism by the out-of-travel equalizing cylinder 271, the slot 259 permits the piston pivot 275 to move toward the lower pivot axis of the driven legs. In this part of the motion the equalizing cylinder is passive.

For purposes of expressing this embodiment of the invention in a general way, the bridge structure 143 and its equivalents may be referred to as "attachment-structure means". Similarly the aforesaid remote end-wall of the slot 259 that is engaged by the sliding pivot or eye 275 may be called "a stop"; the fixed boss 157 in its interaction with the piston-rod pivot or eyelet 175 of the primary cylinder 171 may be called "a pivotal-attachment boss"; and the slot 259 in its interaction with the sliding pivot or eye 275 may be called "release and guide means".

The terminology "release and guide means" is chosen to connote that when the platform is rising, the slot 259 functions to "release" the remote sliding-pivot end 275 of the second cylinder 271 to move away from the stop (after movement of the platform upwardly through a predetermined distance); and when the platform is descending, the slot 259 functions to "guide" the remote sliding-pivot end 275 back to the stop.

As an example if the payweight combined with the platform weight is 150 pounds, the primary cylinder or its gas charge may now be selected to exert 150 pounds upward force near the upper end of curve 2 in FIG. 4—at, say, a scissors angle of fifty-five degrees, where the mechanical advantage is about 0.41. When the scissors angle reaches sixty-four degrees, where the mechanical advantage is about 0.52, the total upward force will be only:

$$\frac{0.52}{0.41} \times \text{(combined weight)}$$

$$\text{or } 1.27 \times \text{(combined weight);}$$
$$= 190 \text{ pounds;}$$

Here the overforce will be just forty pounds, which most users will be able to counteract (for the purpose of lowering the lift) by applying some of the user's body weight to the platform—that is, simply by leaning on it. The primary cylinder 171 will be unable to bear the combined weight at any scissors angle below fifty-five degrees, but the equalizing cylinder 271 will supply the difference in any one of several ways.

For example, at the bottom of the action the primary cylinder will supply only 0.2/0.41 times the necessary combined weight—that is to say, about half. The equalizing cylinder could be made to supply the other half. Since the baseline (the equivalent of the parameter c in FIG. 2) for the equalizing cylinder is much longer than the baseline for the primary cylinder, the former cylinder will follow a somewhat different curve, and will run out of travel at some scissors angle between, say twenty and fifty-five degrees.

A great variety of different behaviors can be provided, depending upon the choice of baseline, cylinder force and extension, and so on. If the equalizing cylinder is made to run out of travel at fifty-five degrees or more (continuing the previous discussion of curve 2), then the equalizing cylinder will in effect "hand off" the combined weight to the primary cylinder at a point where the latter can generally bear the weight. This is not necessary, however; rather, the operation of the equalizing cylinder can be made to run out of travel at rather low scissors angles, such as twenty or even fifteen degrees. If the force applied during those initial twenty or fifteen degrees is great enough, and the speed at which the equalizing cylinder extends itself is great enough, the payweight and platform weight can be made to accumulate upward momentum sufficient to carry them through the "deficit"-upward-force region to the fifty-five-degree point. In effect, the equalizing cylinder only equalizes the top and bottom of the operating range, leaving the platform to "coast upward" through the intermediate region. From the earlier discussion of FIG. 5 it will be clear that the point at which the equalizing cylinder is made to "run out of travel" is controlled by the location of the remote end of the slot 259 (FIG. 5), in relation to the equalizing-cylinder stroke and piston-rod length, and in relation to the locus of the scissors forcing point.

In one generally satisfactory prototype that has been constructed, the remote end-wall of the track or slot 259 (FIG. 5) is approximately 22.1 inches from the lower pivot point of the driven scissors leg 22, and the slot 259 itself is approximately 7.4 inches long. Thus the effective base length c for the equalizing cylinder 271 is 22.1 inches, and the equalizing-cylinder's piston-rod pivot or eyelet 275 has 7.4 inches of "free" travel along the slot 259 after running out of working travel. This particular unit operated by the "hand-off" approach mentioned in the preceding paragraph.

In any event, the important consideration is to bring the upward platform forces at the two ends of the operating range within a small permissible discrepancy, so that the mechanism essentially bears the combined weight at both ends of the range, leaving the direction of motion at both ends to be controlled by mere pilot forces. As previously mentioned, in one embodiment of the invention the mechanism may be made to slightly more than bear the combined weight—so that the user must press downward slightly to lower the payweight, and engage a catch at the bottom of the action to hold the payweight down, whereas it rises unaided when the catch is released.

In another embodiment of the invention, the mechanism may be made to not quite bear the combined weight —so that the user must pull upward slightly to raise the payweight (from the bottom of the action), and engage a catch at the top of the action to hold the payweight up, whereas it descends unaided when the catch is released.

In yet another embodiment, the mechanism may be made to either slightly more than bear the combined weight or not quite bear the combined weight, with the necessary upward and downward direction-controlling pilot forces supplied by a small motor and screw drive (or worm and worm gear), or a small hydraulic or pneumatic cylinder. If desired, any of these devices can be made to supply the necessary retaining forces when not activated, to obviate the need for a separate mechanical catch.

The pilot-force device in effect provides remote control—though it need not be any more "remote" than a switch on the console or cabinet which houses the lift. If preferred the control switch can be on a nearby panel, or across a room (as in the case of a lift-mounted television set), or even in another room (as in the case of computer equipment or banking equipment that is to be secured against intruders or other unauthorized access). Accordingly the phrase "controlled remotely" is hereby defined, for the purposes of the appended claims, as encompassing a control device that is mounted to the lift-enclosing cabinet, as well as a control device that is mounted more remotely from the lift mechanism.

Figure 6:
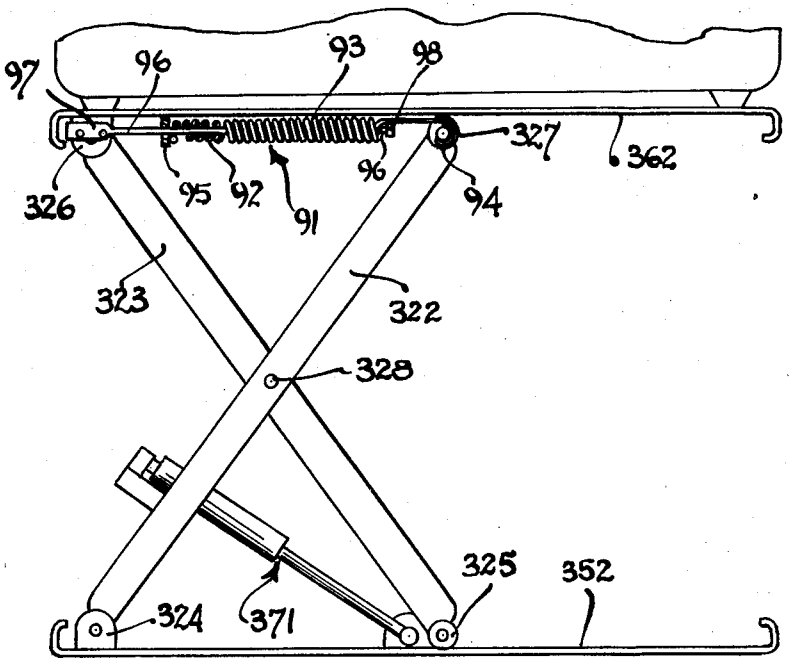
FIG. 6 is a side elevation (similar to that of FIG. 2) of yet another embodiment, which incorporates an equalizing or compensating spring in addition to the gas cylinder of FIGS. 1 through 3.

Another embodiment of the invention appears in FIG. 6. Here the equalizing cylinder 271 of FIG. 5 is replaced by an equalizing spring 91. This spring is shown partly in cross-section in the area 92, for clarity of explanation. As shown, one end of the spring leads to a hook 94 or like device for engaging the pivot pin at the center of the wheel 327, at the top of the driven leg 322. The other end of the spring 91 is welded, or otherwise suitably attached, to a washer or ring 95. Through the center of the spring 91, and through the center hole of the washer 95, is a rod 96; this rod is attached by a suitable bracket 97 to the boss 326 on the underside of the platform 362. The rod extends horizontally toward the wheel 327, and has a head or flange 98 which is too large to pass through the central hole in the washer 95.

As the scissors mechanism approaches the fully—or almost fully—retracted position, the wheel 327 moves progressively further from the boss 326. Accordingly the spring 91 is pulled to the right, along the rod 96, by the wheel 327, so that the washer 95 engages and is stopped by the flange 98. With further retraction, since the left end of the spring cannot move further rightward, the spring 91 is stretched—storing energy in extension of the spring.

By proper selection of the spring constant, spring length, and other parameters, the spring 91 can be made to supply equalizing force near the bottom end of the action sufficient to permit lowering the lift by application of pilot forces near the top end of the action. As will be plain in the light of the foregoing disclosure, various other ways of arranging springs to accomplish this task are possible. For example, springs can be arranged to push and be compressed, rather than to pull and be stretched. In most embodiments of the invention that use springs, the relatively steep force-versus-travel characteristic of springs will militate in favor of using the "coasting upward" approach mentioned earlier in connection with the equalizing gas-cylinder embodiment, rather than the "hand-off" approach.

Once again it must be emphasized that the objective here is to bring the raising force at the extended positions into rough equality with the raising force at the retracted positions, so that there is no excessive overforce at the extended positions—and not merely to supply sufficient force to raise the scissors lift from its retracted position. Gas cylinders, and relatively lightweight scissors mechanisms, are readily available in configurations capable of lifting even 200- and 300-pound weights, and the problem of binding that is explored in the prior art is readily soluble by means considerably short of those employed in the present invention for equalizing purposes. In none of the embodiments of the present invention is the primary cylinder disconnected, or its forcing action reversed or diminished, as in all of the prior art.

Figure 7:
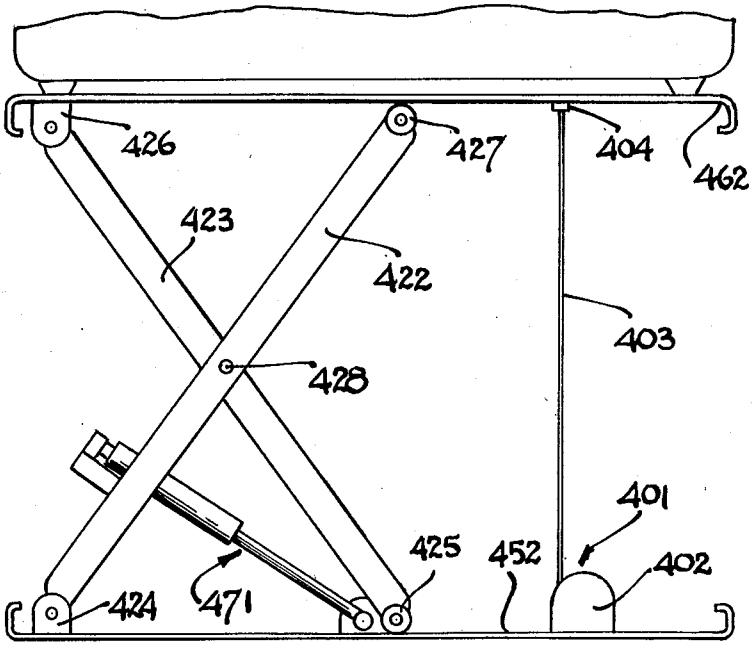
FIG. 7 is a side elevation (similar to that of FIGS. 2 and 6) of still another embodiment, which incorporates a different type of equalizing or compensating spring in addition to the gas cylinder of FIGS. 1 through 3.

Another embodiment of the present invention appears in FIG. 7. Here the equalizing function is performed by a spring reel 401, which acts in a different way than the embodiment of FIG. 6—although the general principles of the two embodiments are related. The spring reel has a case 402 in which a conventional mechanism allows travel of the tape 403 out of the case without mechanical resistance (or with very little resistance), but only for a certain specified distance. Once the tape 403 has moved out of the case 402 by that distance, an internal spring (not shown) comes into play and applies increasing force in opposition to the further outward motion of the tape. The reel case 402 is secured to the base flooring 452, and the remote end of the tape 403 by a fitting 404 to the platform 462—or vice versa, so that the internal spring, once it comes into play, opposes extension of the platform. The reel 402, tape 403, and fitting 404 are out of the plane of operation of the scissor legs and wheels, so that there is no interference with the retraction of the scissors mechanism.

The direction of action here—pulling the bottom and top of the scissors toward each other, rather than pulling the tops of two legs of the scissors toward each other—produces an oppositely directed motion from that of FIG. 6. The spring reel is used to oppose and cancel the large overforce at the top of the mechanical-advantage curve 2 of FIG. 4; this leaves the gas cylinder to only generally bear the weight of the platform, and of the article on the platform, as in the other embodiments already described. (It will be noted that a similar mechanism could be used between the boss 326 and wheel 327 of FIG. 6, in place of the spring 91 and guide/limit rod 96 there shown.)

Figure 8:
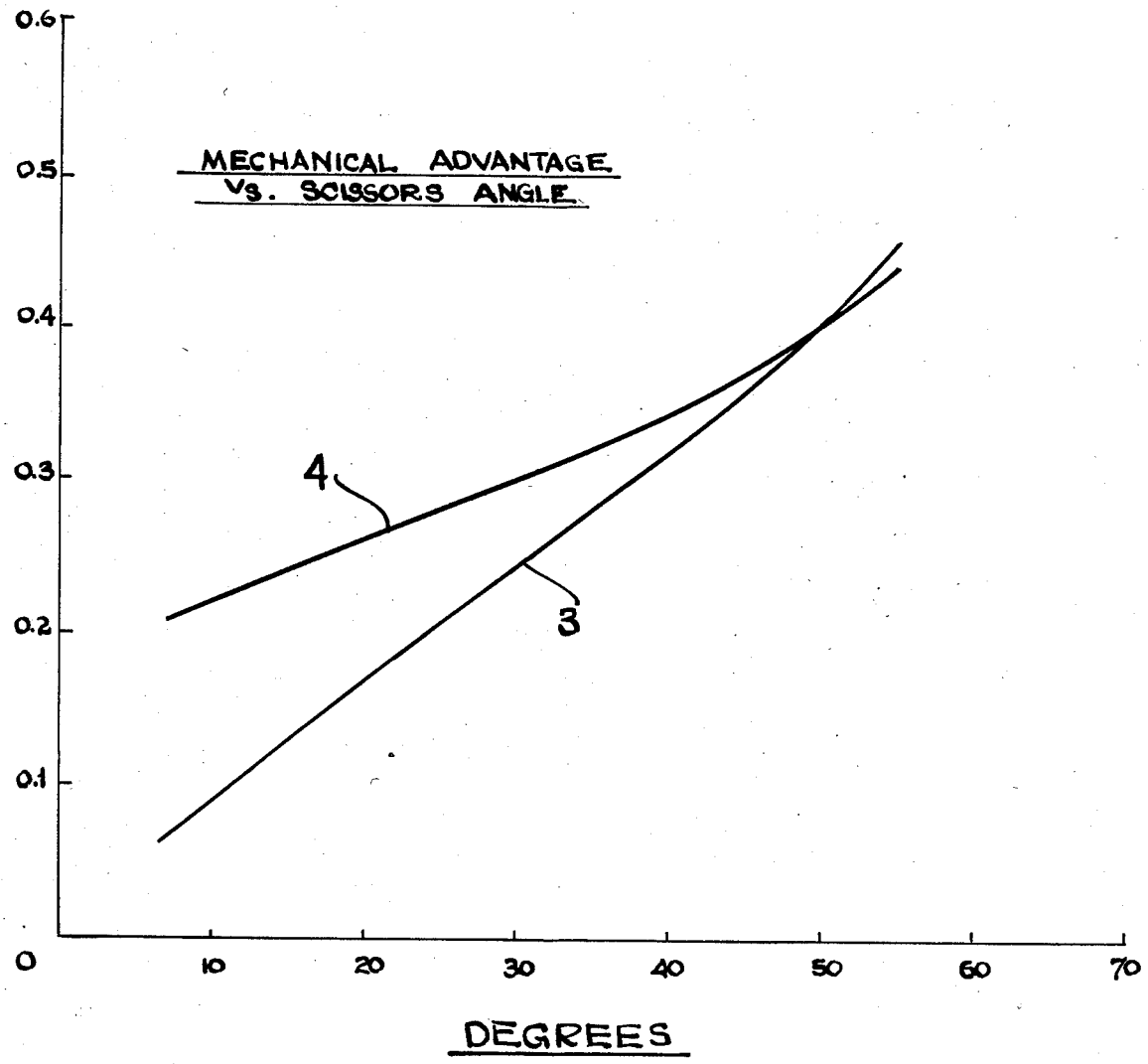
FIG. 8 is a graph (similar to that of FIG. 4) showing the calculated mechanical advantage which the gas cylinder of FIGS. 1 through 3 has on a weight placed on the platform, for the embodiment of the invention which is currently the most preferred. The mechanical advantage is also shown for another embodiment of the invention which is not preferred but which is discussed in the text.

Another approach to moderating the extreme variation of mechanical advantage of the scissors linkage is represented by FIG. 8. Curves 3 and 4 are analogous to curves 1 and 2, respectively, of FIG. 4—but there are two changes, or groups of changes. First, the dimensions and their ratios have been changed slightly. The leg lengths, particularly the segments above the central pivots (such as 28 in FIGS. 1 through 3), are slightly increased. Secondly, the range of operation as to the scissors angle is decreased: the mechanism goes only to fifty-five degrees, rather than sixty-four degrees. Thirdly, the range of operation as to the platform height is slightly decreased. As a result of these various compromises, nearly the same platform stroke is obtained but the very steep uppermost part of the mechanical-advantage curve is cut off—that is, the mechanism is not used in that unfavorable region.

Consequently, even though curves 3 and 4 are very slightly steeper than curves 1 and 2, respectively, the overall variation of mechanical advantage is more acceptable. The total variation for curve 4 (FIG. 8), the preferred embodiment, is from 0.21 at seven degrees to 0.44 and fifty-five degrees; and the platform stroke is about 21.7 inches, reasonably comparable to that for curve 2 (FIG. 4). The dynamic range is now:

$$0.44/0.21=2.1,$$

which is lower than the 2.6 obtained previously for curve 2. Using these dimensions and operating range for the embodiments shown in FIGS. 5, 6 and 7 and already discussed, even smoother and easier operation can be obtained than with the dimensions and operating range assumed earlier.

The assumptions used in the calculations shown in FIG. 8 are that the leg length d is 31.125 inches, the base length c is 16.65 inches, and the forcing-point radius b is 8.123 inches. As before, the forcing-point radius b is roughly a quarter the leg length—rather than nearly half as in the closest prior art. The forcing-point offset angle B is zero in curve 3 (as in curve 1), and 22.2 degrees in curve 4. The invention encompasses yet another area of innovation which produces operation far superior to that obtainable with any embodiment yet described. This area of innovation leads to another embodiment of the invention which is now considered the preferred one, because the upward force on the platform is rendered virtually constant —almost independent of scissors angle—over the entire operating range of the mechanism as defined by curve 4 (FIG. 8). This means that the overforce (if any) provided at the retracted position is very nearly the same as the overforce (if any) provided at the extended position (fifty-five degrees). Furthermore, this can be accomplished without providing a separate equalizing cylinder, spring, spring reel, or the like.

The key to this innovation resides in the known available variants or modifications of sealed gas cylinders, and particularly in the use of various amounts of oil for damping, and for provision of a cushioning effect in known applications such as office chairs, previously mentioned. By adding oil to gas cylinders a manufacturer changes not only the damping but also the cylinder volumes available for expansion of the gas, at various piston positions. By the classical gas laws, the addition of oil therefore changes the gas pressure at various piston positions—and in fact the ratios of gas pressures for respective various piston positions.

The result of changing the gas-pressure ratios corresponding to various piston positions is in turn to change the fractional force increment observed at zero piston extension relative to full piston extension. For instance, when there is no oil added the force-versus-travel characteristic of a gas cylinder can be made nearly flat (as in curve 5 of FIG. 9)—originally considered particularly desirable, since the force-versus-travel characteristic of springs is too steep.

By adding selected quantities of oil, however, the cylinder force at zero extension can be made—for example —1.84 times the force at full extension (curve 6 of FIG. 9), or can be made 2.07 times the force at full extension (curve 7 of FIG. 9), etc. It is not within the scope of this document to describe how this is to be done, and it is not necessary to offer such a description here since it is within the established manufacturing capabilities of a gas-cylinder manufacturer to provide cylinders in which the force function varies in the general way indicated and has an overall force variation to be specified by the buyer.

The idealized force-versus-travel characteristic of these cylinders, customized to the application at hand, is essentially a straight line when plotted against piston extension. When plotted against scissors angle as in FIG. 9, each characteristic curve appears as two very nearly straight segments connected by a rather abrupt inflection point, as can be seen by careful examination of each of curves 6 and 7.

Curves 6 and 7 are angled or slanted in the opposite direction from curve 4, indicating that for the geometry of FIGS. 1 through 3 the cylinder force is lower at large scissors angles, whereas the scissors mechanical advantage is higher at large scissors angles. When these two characteristic curves (that is, curves 6 and 4, or curves 7 and 4) are multiplied together—as is the case when a cylinder whose characteristic resembles those in FIG. 9 is used to drive a scissors whose characteristic approaches curve 4—these opposing slants tend to cancel each other out.

Figure 9:
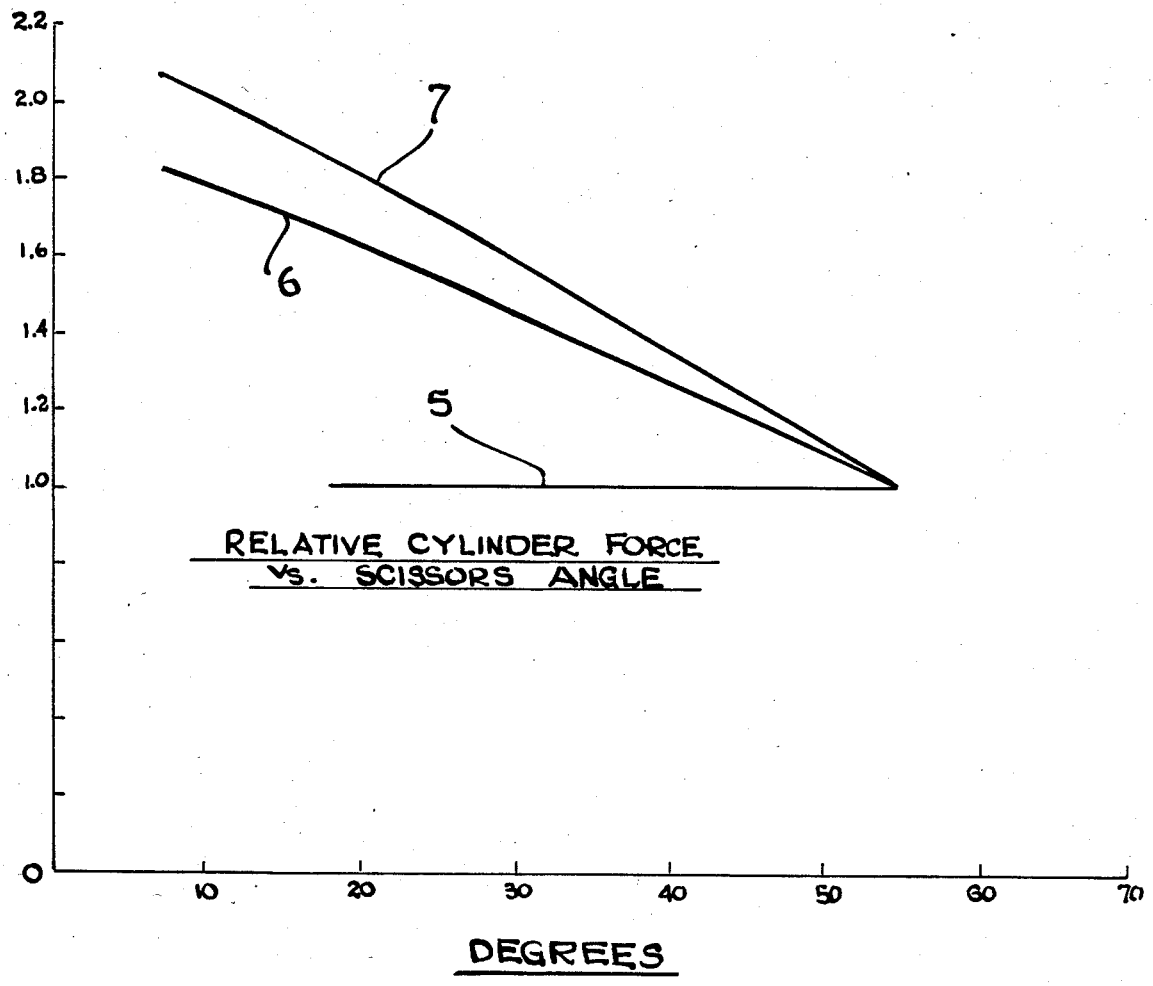
FIG. 9 is a graph showing the force at the piston of the sealed gas cylinder(s) of FIGS. 1 through 3 and 5 through 7, for three different internal configurations of the gas cylinder.

FIG. 9 is presented as "relative" cylinder force, the reference 1.0 value being the value at full cylinder extension. This value is in fact usually the nominal force value assigned to a gas cylinder. Thus the force values at positions leftward from the nominal value represent multipliers to be applied to the nominal force stated by the manufacturer for the cylinder. When these relative force values are multiplied by the mechanical-advantage values at corresponding scissors angles, the result may be called relative platform force: it is the upward force on the platform per unit nominal cylinder force.

For example, if a cylinder has a nominal force value of 500 pounds, its force at full extension (piston all the way out) is 500 pounds. In the mechanism of the preferred embodiment of the present invention, the piston is at full extension at scissors angle of fifty-five degrees, where the scissors mechanism has a mechanical advantage of 0.44 (curve 4, FIG. 8); consequently the upward platform force is 0.44 times 500 pounds, or 220 pounds. In terms of relative platform force, the system offers a value of $1.0 \times 0.44 = 0.44$.

The same cylinder supplies force at zero extension (piston all the way in), assuming curve 7, of 2.07 times 500 pounds, or 1,035 pounds; here, however, the mechanical advantage is only 0.21, so the force applied is 0.21 times 1,035 pounds, or 217 pounds—only three pounds different from the value at full extension!

In terms of relative platform force, the value is $2.07 \times 0.21 = 0.43$, extremely close to the relative force value of 0.44 found above at full extension.

Figure 10:
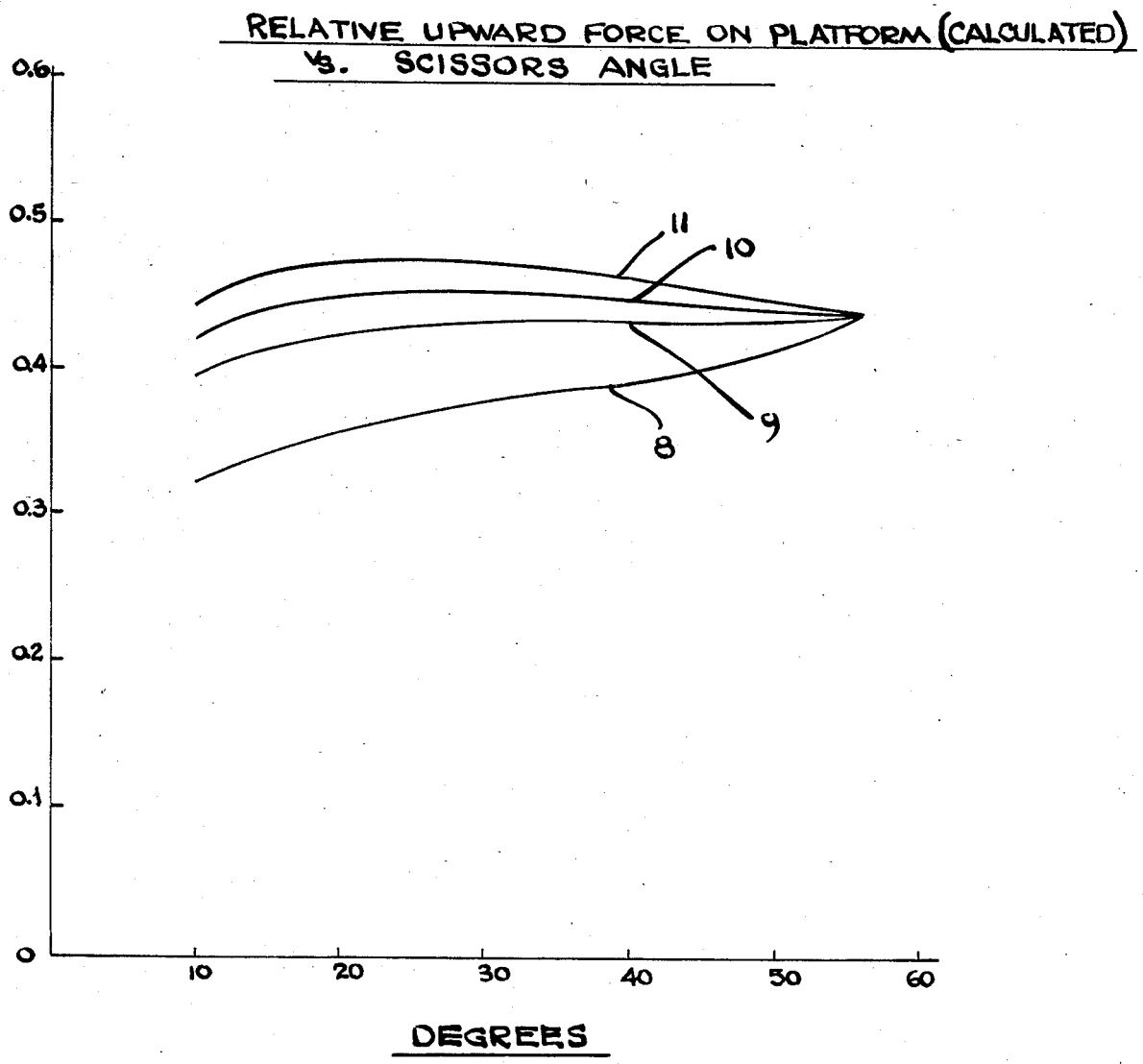
FIG. 10 is a graph showing the calculated upward force on the platform for four internal configurations of the gas cylinder, in combination with the preferred mechanical advantage of FIG. 8.

By judicious choice of parameters the overall force characteristic at the platform can be made practically flat. FIG. 10 shows several different relative-platform-force characteristic curves that result from combining curve 4 (FIG. 8) with different relative-cylinder-force curves. Curve 8 results from using a relative-cylinder-force characteristic that is not shown in FIG. 9, since it is not preferred, but that is relatively commonplace for other gas-cylinder applications. Its value at zero extension is about 1.51. Curve 8 rises from about 0.3 to about 0.44—really a remarkable improvement over the other systems already analyzed and described above, but only a start in terms of the potential of this area of innovation.

Curve 9 of FIG. 10 results from combining curve 4 (FIG. 8) with curve 6 (FIG. 9). This combination characteristic is a very shallow curve, varying only from 0.375 to 0.44 over the entire range of operation from seven to fifty-five degrees. Thus if the gas charge in the cylinder were chosen to generally bear a 150-pound weight at the platform with the scissors retracted, the total upward force with the scissors extended would be only:

$$\frac{0.44}{0.375} \times 150 \text{ pounds} = 176 \text{ pounds},$$

an overforce of only twenty-six pounds.

Most or at least many users would be able to lean on the platform with sufficient force to lower a weight twice as heavy as the one under discussion—that is, a 300-pound combined platform weight and payweight—using the system now being described.

It would appear that the left end of the overall relative-platform-force curve could be raised even further and the behavior of the system thereby made even more desirable by using an even steeper cylinder function such as that of curve 7 in FIG. 9. This combination, as previously shown, produces platform forces only three pounds apart at the top and bottom of the operating range, for a 150-pound load.

Calculations suggest, however, that a peculiar phenomenon may occur when this is done: the results are plotted as curve 11 in FIG. 10. This configuration has not been tested, and it may be that the concerns or limitations discussed below do not materialize. Indeed, as anticipated, the left end of the overall platform-force function moves even closer to the right end in relative force value: the relative force at full-retracted position of the scissors is 0.43, and at the extended position (fifty-five degrees) is 0.44. It is plainly possible to exactly equalize the two, should that be desired.

The curve at intermediate scissors angles, however, is bowed quite noticeably upward as indicated by curve 11 (FIG. 10). The maximum relative force is slightly above 0.47. The corresponding overforce is not very large—only about six pounds for a 150-pound combined weight—but the "feel" as experienced by a user attempting to push the lift down might be quite different from that corresponding to curve 9. In particular, the user might notice an increase in the resistance to lowering the lift as he moved the platform downward; this increase would continue all the way from scissors angle of fifty-five degrees down to about twenty-five or thirty degrees. The resistance would then finally level off and decrease.

From a human-engineering standpoint this gradual increase of resistance with downward progress of the lift might be slightly annoying. Possibly it could be made less noticeable by increasing the total of the required downward force, but this simply discards the advantage offered by the force characteristic. Accordingly it may be preferable to aim for a curve such as curve 10 (FIG. 10), which results from a cylinder-force curve intermediate to curves 6 and 7 (FIG. 9).

A cylinder-force curve rising to a relative cylinder force of about 1.95 at zero extension (scissors angle seven degrees), combined with the mechanical-advantage curve 4 (FIG. 8), would produce curve 10 (FIG. 10). The upward bow of curve 10 is extremely slight, not reaching even to 0.45, and the zero-extension end (at seven degrees) is at 0.40. The overforce would be definitely larger (nineteen pounds for a 150-pound weight) at the thirty-degree mark than for curve 11, but the resulting increase of resistance with downward progress would almost surely be imperceptible.

Curve 9 appears to be very nearly the shallowest curve available which does not bow upward at intermediate angles.

As to the appearance of the apparatus that is to be made according to this preferred embodiment, FIGS. 1 through 3 illustrate it as well as the basic embodiment of the invention, since the cylinder that has been custom pressured and custom oil-filled appears externally just as a cylinder that has not been so treated. There are some differences internally. For example, the internal oil-flow-resistance apertures are advantageously made larger—so that the increased oil volume does not result in excessive speed damping. (It will be recalled that the conventional primary purpose of adding oil is to increase the damping.)

As previously indicated the analyses presented above are based upon calulations. The presentation has been made in this way simply because, and only because, the invention is particularly amenable to explanatory presentation, leading to a relatively deep level of understanding, in this way. The invention was not made, however, by doing calculations—the calculations were done subsequently—and the invention is not to be limited in any way by any of the foregoing numerical or graphic presentations.

Furthermore, devices made in accordance with the invention should not be expected to perform in close adherence to these presentations. Many departures from the theoretical may be expected to arise from geometric imperfections, from friction, "stiction," and other sources of hysteresis in the mechanism. The calculations do not account for the effective weight of the scissors legs and bridge, and they do not account for departures of the cylinder force characteristic from the idealized functions described.

For example, an energy-recycling scissors lift has been constructed according to the specifications that were assumed in deriving curve 9 (FIG. 10). This prototype has been subjected to very rough measurements, using informal methods and relatively elementary measuring equipment, and yielding the raw data shown plotted in FIG. 11.

In that figure, curve 12 represents measurements made while moving downward—that is to say, by using a payweight that is exceeded by the upward platform force at all positions of the scissors, and by applying downward force to a scale placed atop the payweight and recording the scale indication at various points in the downward progress. Curve 13 represents similar measurements made while moving upward—that is to say, by using a payweight that exceeds the upward platform force, and by applying upward force via a spring scale to the platform and observing the scale reading at various points in the upward progress.

The curves suggest a considerable amount of hysteresis, and their shapes do not closely conform to those in FIG. 10 generally—or to curve 9 in particular. In fact curves 12 and 13 are concave upward whereas curve 9 is, if anything, concave downward. Nevertheless curves 12 and 13, and especially curve 13, are strikingly similar to curve 9 in that (1) both are very generally flat and (2) both vary between about 0.38 and values slightly above 0.4 —namely, 0.41 for curve 13, and 0.44 for curve 9.

In view of the ultimately practical object of the invention and the many sources of discrepancy enumerated above, the agreement with the analytical values seems very satisfactory. Moreover, the performance of the prototype mentioned, and other prototypes that have also been made and put into use, completely satisfies all the objectives described in the introductory parts of this document.

Figure 11:
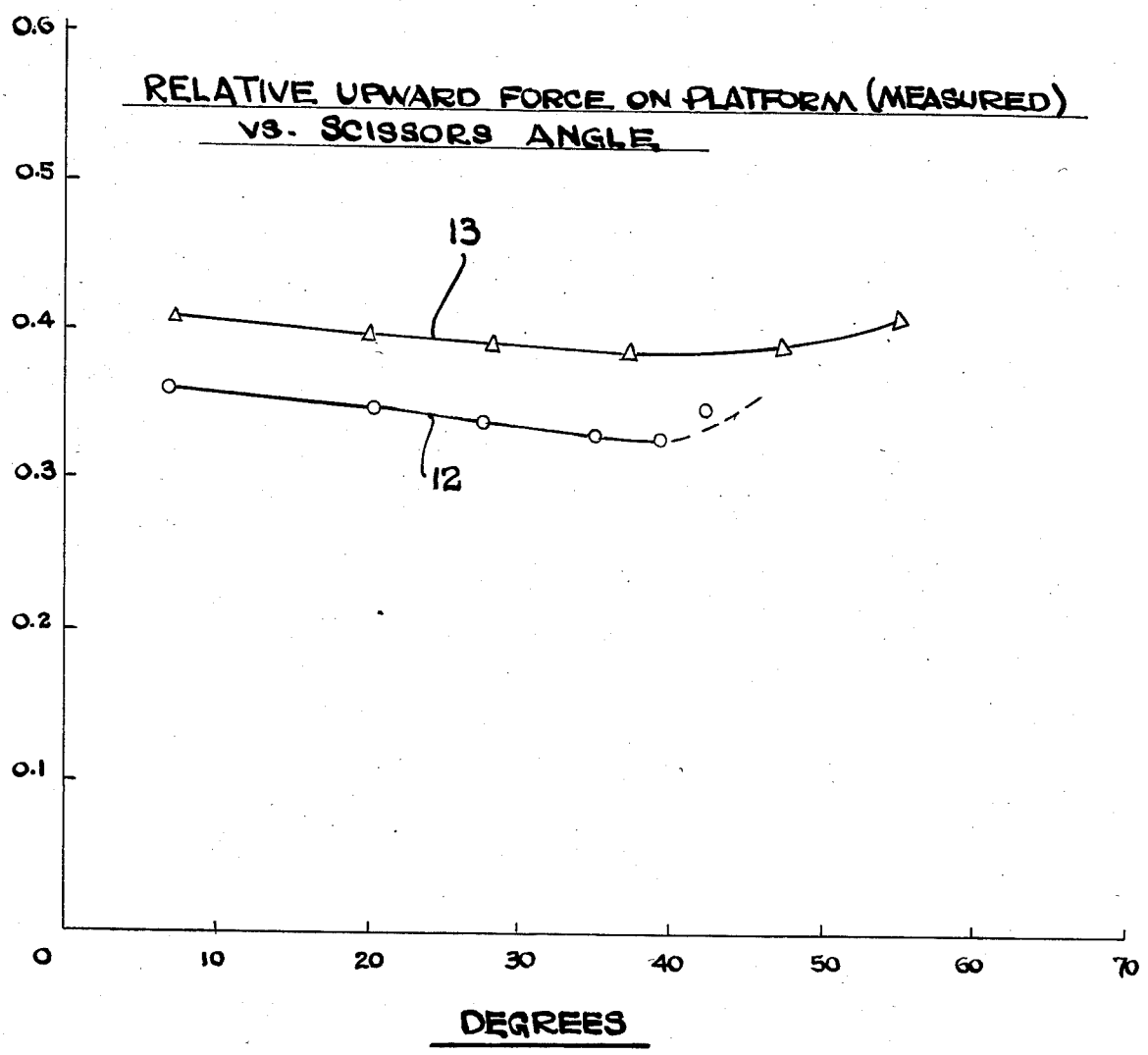
FIG. 11 is a graph showing the results of rough measurements of the upward force on the platform, for one gas-cylinder configuration, in combination with the scissors configuration that yields the preferred mechanical-advantage curve of FIG. 8.

Both of the curves in FIG. 11, as well as all of the curves in FIG. 10, represent performance exceeding any of the previously discussed embodiments, by virtue of the smaller force variations—and also by virtue of the simplicity of the mechanical system. A single scissors-lift mechanism can be made to serve a very wide range of payweights, and involves only one component that varies from one payweight to another—namely, the custom-pressured and custom-oil-filled gas cylinder. Installation of that one component is a matter of a minute's work. Hence warehousing and other manufacturing costs can be kept to an absolute minimum, and labor costs, including those at final assembly, are minimal.

As can now be seen, all of the embodiments of the invention provide faster, smoother and quieter operation than previous units that are powered up by hydraulic, pneumatic or electrical systems. The several embodiments of the invention are also lighter and simpler to ship and to maintain: there is only one part that is significantly subject to failure, and that part is quite inexpensive and has a normal replacement schedule that runs in terms of years at the least.

Figure 12:
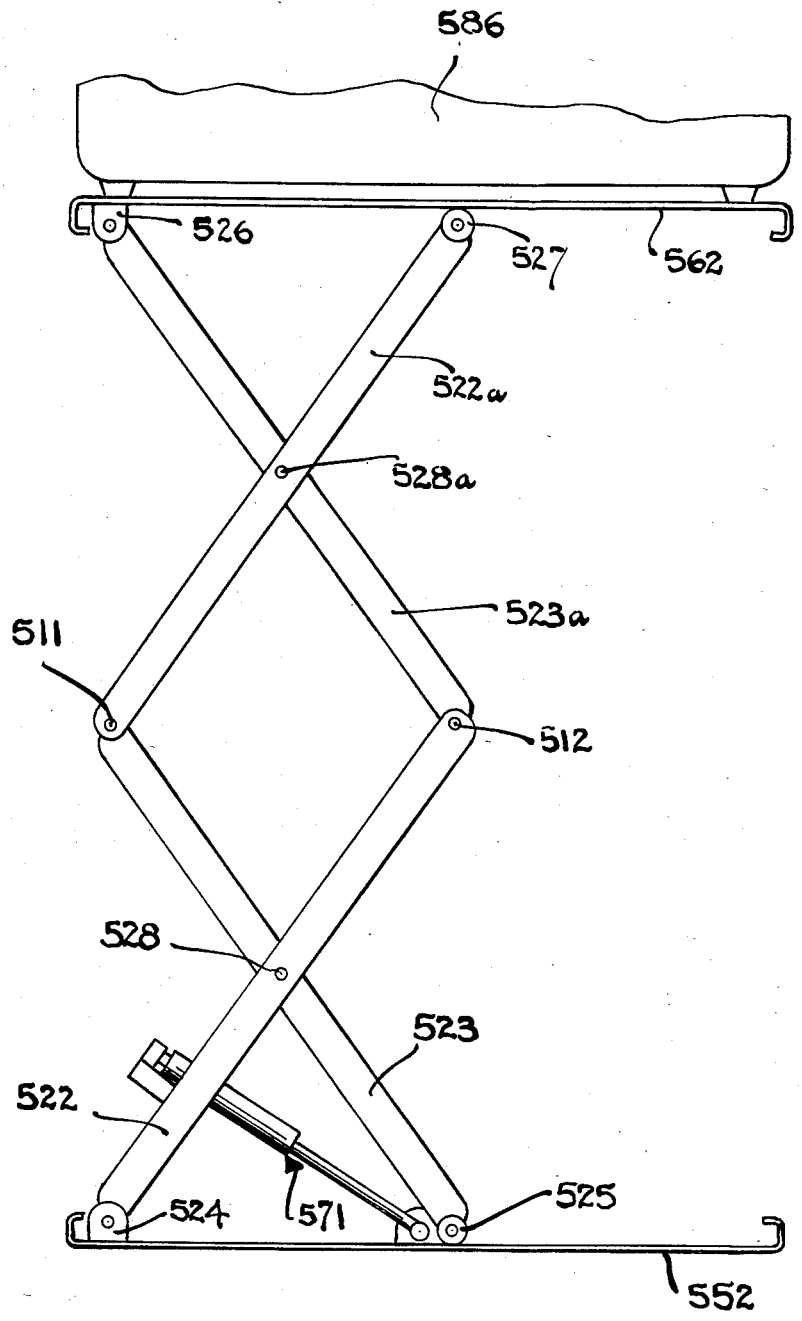
FIG. 12 is a side elevation, similar to those of FIGS. 2, 3, 6 and 7, showing an alternative embodiment of the invention that incorporates a two-stage scissors mechanism.

The only significant compromise made in developing the preferred embodiment described was, as will be recalled, in the length of the platform stroke. Ample stroke, however, can be obtained as a variant embodiment of the most highly preferred embodiment described above (or any of the other important embodiments), by using a two-stage scissors, as shown in FIG. 12. In this drawing the top ends of the bottom-stage legs 522 and 523 are pivotally secured to the bottom ends of the top-stage legs 522*a* and 523*a*, by pivot pins 511 and 512. The other reference numerals in FIG. 12 are similar to those used for analogous components shown in earlier drawings, with the addition of or change to a suffix "5". The cylinder 571 shown here may be custom pressured and custom oil-filled as already described (or other equalizing/compensating means may be used instead).

Yet another embodiment of my invention encompasses having custom-made a sealed gas cylinder whose dimensions —both on an absolute and on a relative basis—provide precisely the cylinder force-versus-travel characteristic that is required for a particular high-manufacturing-volume application, without addition of oil other than what is required for sealing and lubrication.

The invention is not limited to the use of sealed gas cylinders as energy-storing means. Based upon the extensive understanding of the invention that has been gained through working with gas cylinders, and which has been presented above, it is believed that for some applications the principles of the invention can be successfully applied using springs or other energy-storage means instead of gas cylinders. For instance, the use of plural, parallel springs that come into play at respective different regions of the operating range of the scissors—similar to the parallel-cylinder embodiment described above— would appear to make possible other embodiments of the invention having some of the advantages of the already-detailed embodiments.

It is to be understood that all of the foregoing detailed descriptions are by way of example only, and not to be taken as limiting the scope of the invention—which is expressed only in the appended claims.

We claim:

1. A scissors lift for use in repetitively raising and lowering an article, and comprising:

upper and lower support elements arranged for vertical motion of the upper element between a relatively retracted position and a relatively extended position above the lower element, the upper support element being adapted to hold such article;

a scissors mechanism pivotally connected to the upper support element and pivotally connected to the lower support element for carrying the upper element above the lower element, said scissors mechanism including a pair of scissors legs having ends which in operation translate along the support elements;

attachment-structure means secured to at least one scissors leg;

a stop and a pivotal-attachment boss respectively fixed to one of the support elements;

first sealed gas cylinder means, having a first end that is pivotally fixed to the attachment-structure means and having an opposed second end that is pivotally fixed to the pivotal-attachment boss, for operating the scissors mechanism to move the upper support element upwardly from the retracted position and to the extended position; and second sealed gas cylinder means, having a first end that is pivotally fixed to the attachment-structure means and having an opposed second end that is restrained by said stop when the upper support element is in and near the retracted position, for assisting said first sealed gas cylinder means in operating the scissors mechanism to move the upper support element upwardly from the retracted position through a predetermined distance toward but not to the extended position; and release and guide means for permitting said opposed second end of the second cylinder to move away from said stop after movement of the upper support element upwardly through said predetermined distance, and for guiding said opposed second end of the second cylinder back to said stop while the upper support element moves from the extended position downwardly toward the retracted position;

whereby the weight of such article on the upper support element is substantially borne by both cylinder means when the upper support element is in the retracted position, but by only the first cylinder means when the upper support element is in the extended position.

2. The scissors lift of claim 1, wherein:

the lower and upper support elements are respectively a base and a platform elevated above the base; and the scissors mechanism legs are fastened together substantially at their midpoints for mutual rotation, one end of a first one of the legs is pivotally connected to the base, the other end of the first one of the legs translates along the platform, one end of the other leg is pivotally connected to the platform, and the other end of the other leg translates along the base.

3. The scissors lift of claim 2, also comprising:

another scissors mechanism, substantially identical to the first-mentioned scissors mechanism, that is substantially identically disposed and attached to the support elements and to the attachment-structure means, but which is offset from the previously recited scissors mechanism in a direction perpendicular to the direction of translation of any one of said scissors-leg ends which translate along the support elements.

4. The scissors lift of claim 2, wherein:

the attachment-structure means are attached to the first one of the legs;

the said second end of the first cylinder means is pivotally attached to the base; and the stop is fixed to the base.

5. The scissors lift of claim 1, wherein:

the said second end of the first cylinder means is fixed to one of the support elements at a location that is displaced from a pivotal attachment of the scissors mechanism by roughly half the length of a scissors leg, as measured parallel to the direction of translation of any one of said scissors-leg ends which translate along the support elements.

6. The scissors lift of claim 5, wherein:

the attachment-structure means are disposed at an offset radius that is roughly one-quarter the length of each scissors leg, as measured from one pivotal attachment of the scissors mechanism.

7. The scissors lift of claim 5, wherein:

the attachment-structure means are disposed at an offset angle which is between twenty and twenty-five degrees, as measured about an axis of rotation of pivotal connection of the scissors mechanism, relative to a scissors leg that pivots about said axis.

8. The scissors lift of claim 1, wherein:

the attachment-structure means are disposed at an offset radius is roughly one-quarter the length of each scissors leg, as measured from one pivotal attachment of the scissors mechanism.

9. The scissors lift of claim 1, wherein:

the attachment-structure means are disposed at an offset angle which is between twenty and twenty-five degrees, as measured about an axis of rotation of pivotal connection of the scissors mechanism, relative to a scissors leg that pivots about said axis.

10. The scissors lift of claim 1, wherein:

the said second end of the first cylinder means is fixed to one of the support elements at a location that is displaced from a particular axis of rotation of pivotal connection of the scissors mechanism by roughly half the length of a scissors leg, as measured parallel to the direction of translation of any one of said scissors-leg ends which translate along the support elements;

the attachment-structure means are disposed at an offset radius that is roughly one-quarter the length of each scissors leg, as measured from that particular axis of rotation; and the attachment structure means are disposed at an offset angle which is between twenty and twenty-five degrees, as measured about that particular axis of rotation, relative to a scissors leg that pivots about said axis.

* * * * *